US012595617B2

(12) United States Patent
Attar et al.

(10) Patent No.: US 12,595,617 B2
(45) Date of Patent: Apr. 7, 2026

(54) LAUNDRY APPLIANCE HAVING AN IMPELLER WITH A REMOVABLE FILTRATION STRUCTURE

(71) Applicant: WHIRLPOOL CORPORATION, Benton Harbor, MI (US)

(72) Inventors: Mohsin Mahamadshafi Attar, Kolhapur (IN); Adish Anil Barve, Pune (IN); Joao Arthur Pazzin Curiel, Rio Claro (BR); Luiz Fernando Ferreira, Cordeirópolis (BR); Nimish Deodatta Kavishwar, Thane (IN); Ajiket Jitendrasingh Patil, Aurangabad (IN); Jonathan D. Pugh, Benton Harbor, MI (US); Adilson Correia da Silva, Itu (BR); Arthur Vasques Tosini, Santa Gertrudes (BR); Mahendra S. Wankhede, Pune (IN); Eric James Vasko, Ann Arbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 155 days.

(21) Appl. No.: 18/480,560

(22) Filed: Oct. 4, 2023

(65) Prior Publication Data

US 2025/0116052 A1 Apr. 10, 2025

(51) Int. Cl.

| | |
|---|---|
| ***D06F 39/10*** | (2006.01) |
| ***D06F 13/02*** | (2006.01) |
| ***D06F 17/10*** | (2006.01) |
| ***D06F 39/12*** | (2006.01) |
| *D06F 13/04* | (2006.01) |
| *D06F 13/06* | (2006.01) |
| *D06F 13/08* | (2006.01) |
| *D06F 17/06* | (2006.01) |
| *D06F 17/08* | (2006.01) |

(52) U.S. Cl.

CPC ..... *D06F 39/10* (2013.01); *D06F 13/02* (2013.01); *D06F 17/10* (2013.01); *D06F 39/12* (2013.01); *D06F 13/04* (2013.01); *D06F 13/06* (2013.01); *D06F 13/08* (2013.01); *D06F 17/06* (2013.01); *D06F 17/08* (2013.01)

(58) Field of Classification Search

CPC ..... D06F 17/10; D06F 23/04; D06F 37/40; D06F 39/10; D06F 39/12

See application file for complete search history.

(56) References Cited

U.S. PATENT DOCUMENTS

| | | | |
|---|---|---|---|
| 2,942,444 | A | 6/1960 | Abresch |
| 2,976,711 | A | 3/1961 | Smith |

(Continued)

FOREIGN PATENT DOCUMENTS

| | | | |
|---|---|---|---|
| BR | 102012030892 | A2 | 9/2014 |
| BR | 102015015165 | A2 | 12/2017 |

(Continued)

*Primary Examiner* — Joseph L. Perrin

(74) *Attorney, Agent, or Firm* — Price Heneveld LLP

(57) ABSTRACT

A laundry appliance includes a drum that is rotationally operable within a tub and a rotator that is rotationally operable relative to the drum. The rotator includes an impeller that is axially fixed with respect to the drum and includes a receiver, a removable agitator that is selectively coupled with the receiver, and a filtration structure that is disposed at least within the removable agitator.

20 Claims, 35 Drawing Sheets

(56) References Cited

U.S. PATENT DOCUMENTS

| | | | | |
|---|---|---|---|---|
| 3,027,742 | A | 4/1962 | Nowicki | |
| 3,543,541 | A | 12/1970 | Wasemann | |
| 4,338,802 | A | 7/1982 | Ohmann et al. | |
| 7,882,715 | B2 | 2/2011 | Yoo et al. | |
| 7,926,310 | B2 | 4/2011 | Yoo et al. | |
| 8,020,413 | B2 | 9/2011 | Yoo et al. | |
| 8,033,144 | B2 | 10/2011 | Yoo et al. | |
| 9,238,885 | B2 | 1/2016 | Di Bono et al. | |
| 9,587,336 | B2 * | 3/2017 | Lee | D06F 17/10 |
| 9,903,063 | B2 | 2/2018 | Carpenter et al. | |
| 10,669,661 | B2 * | 6/2020 | Lee | D06F 21/08 |
| 10,731,284 | B2 | 8/2020 | Alexander et al. | |
| 10,920,359 | B2 | 2/2021 | Piekarski et al. | |
| 11,008,695 | B2 * | 5/2021 | Piekarski | D06F 39/10 |
| 11,118,302 | B2 | 9/2021 | Piekarski et al. | |
| 11,149,377 | B2 | 10/2021 | Lee et al. | |
| 11,578,451 | B2 | 2/2023 | Sreevidhas et al. | |
| 11,585,035 | B2 | 2/2023 | Pollett | |
| 2003/0200774 | A1 * | 10/2003 | Kim | D06F 17/06 68/132 |
| 2018/0313021 | A1 * | 11/2018 | Piekarski | D06F 21/06 |
| 2018/0313022 | A1 * | 11/2018 | Piekarski | D06F 37/145 |
| 2018/0313023 | A1 * | 11/2018 | Piekarski | B01D 33/11 |
| 2018/0313024 | A1 * | 11/2018 | Piekarski | D06F 39/088 |
| 2021/0062382 | A1 | 3/2021 | Andrejczuk et al. | |
| 2022/0235512 | A1 | 7/2022 | Bixby et al. | |
| 2022/0290357 | A1 | 9/2022 | Bhavsar et al. | |
| 2022/0298704 | A1 | 9/2022 | Pollett | |
| 2022/0316126 | A1 | 10/2022 | Bhavsar et al. | |
| 2023/0026944 | A1 * | 1/2023 | Shinde | D06F 23/04 |

FOREIGN PATENT DOCUMENTS

| | | | |
|---|---|---|---|
| CN | 105155193 | A * | 12/2015 |
| GB | 987685 | A | 3/1965 |

* cited by examiner

LAUNDRY APPLIANCE HAVING AN IMPELLER WITH A REMOVABLE FILTRATION STRUCTURE

BACKGROUND OF THE DISCLOSURE

The present disclosure generally relates to laundry appliances, and more specifically, to a laundry appliance that includes an impeller that rotationally operates with respect to a rotating drum, and where the impeller includes a removable filtration structure that filters particulate from process fluid that is used for treating articles within the drum.

SUMMARY OF THE DISCLOSURE

According to one aspect of the present disclosure, a laundry appliance includes a drum that is rotationally operable within a tub and a rotator that is rotationally operable relative to the drum. The rotator includes an impeller that is axially fixed with respect to the drum and includes a receiver, a removable agitator that is selectively coupled with the receiver, and a filtration structure that is disposed at least within the removable agitator.

According to another aspect of the present disclosure, a laundry appliance includes a drum that is rotationally operable within a tub and a rotator that is rotationally operable relative to the drum. The rotator includes an impeller that is axially fixed with respect to the drum and includes a receiver, a removable cassette that is selectively coupled with the receiver, and a filtration structure that is disposed at least within the receiver of the impeller.

According to yet another aspect of the present disclosure, a laundry appliance includes a drum that is rotationally operable within a tub and a rotator that is rotationally operable relative to the drum. The rotator includes an impeller that is axially fixed with respect to the drum and includes a receiver, a removable agitator that is selectively coupled with the receiver, and a filtration structure that is defined by the receiver and operable between a first filtering position characterized by the removable agitator being in an installed position and a second filtering position characterized by the removable agitator separated from the receiver.

These and other features, advantages, and objects of the present disclosure will be further understood and appreciated by those skilled in the art by reference to the following specification, claims, and appended drawings.

Figure 1:
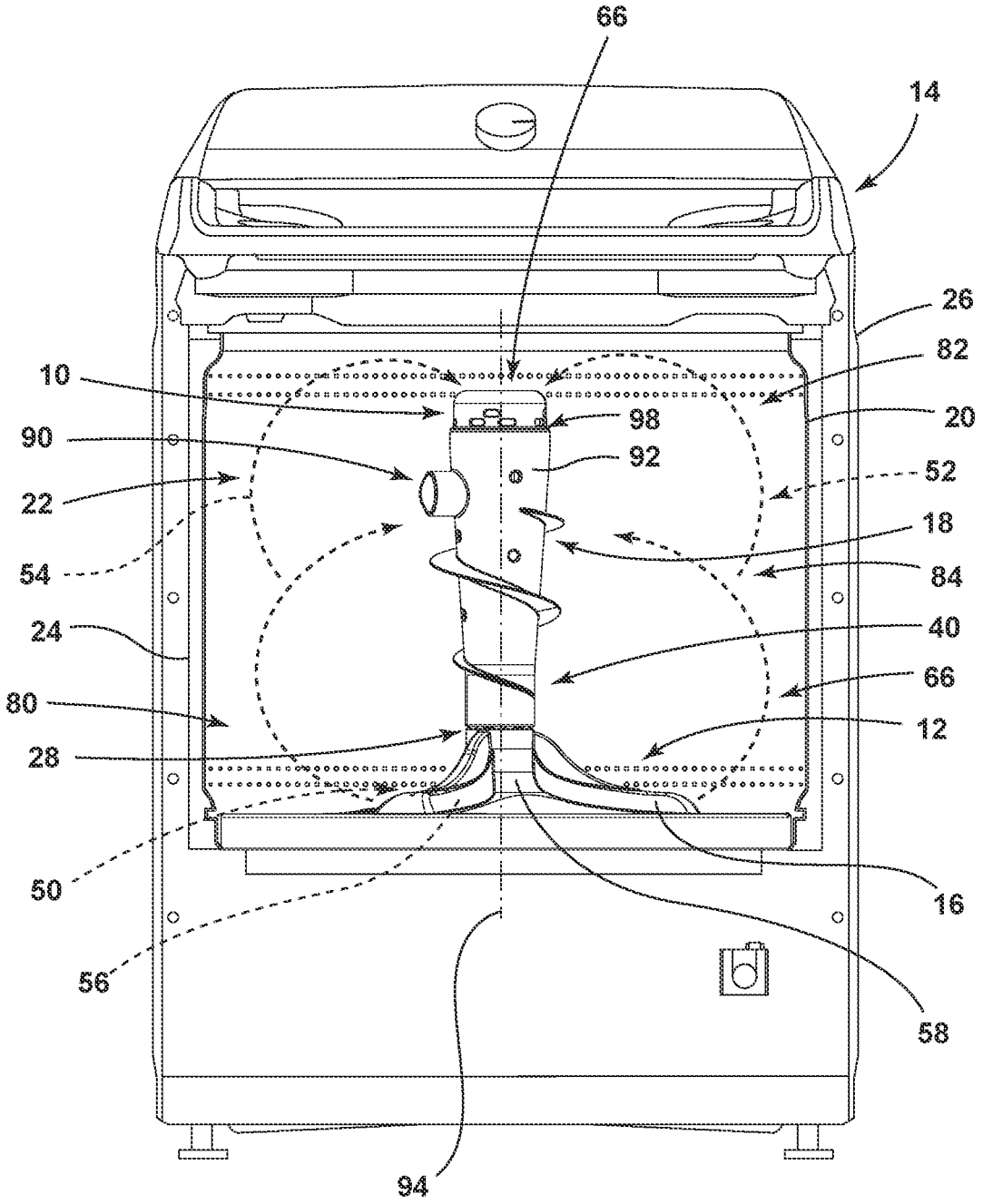
FIG. 1 is a cross-sectional view of a vertical axis laundry appliance that incorporates an aspect of a filtration structure that is selectively removable from an impeller.
Figure 2:
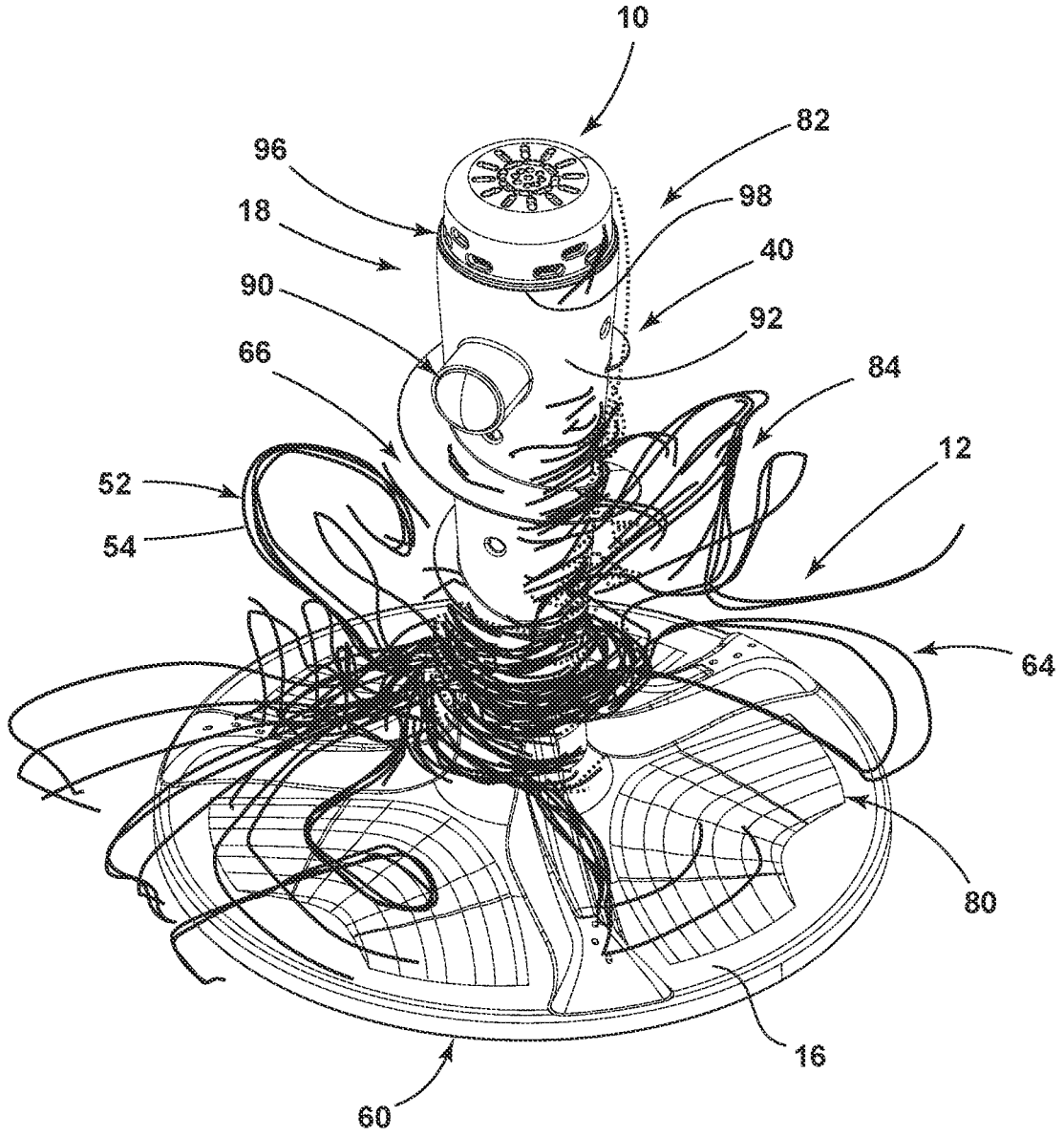
FIG. 2 is a schematic diagram illustrating an aspect of the impeller having a removable filtration structure, and showing an aspect of the toroidal flow of process fluid through a processing space.
Figure 3:
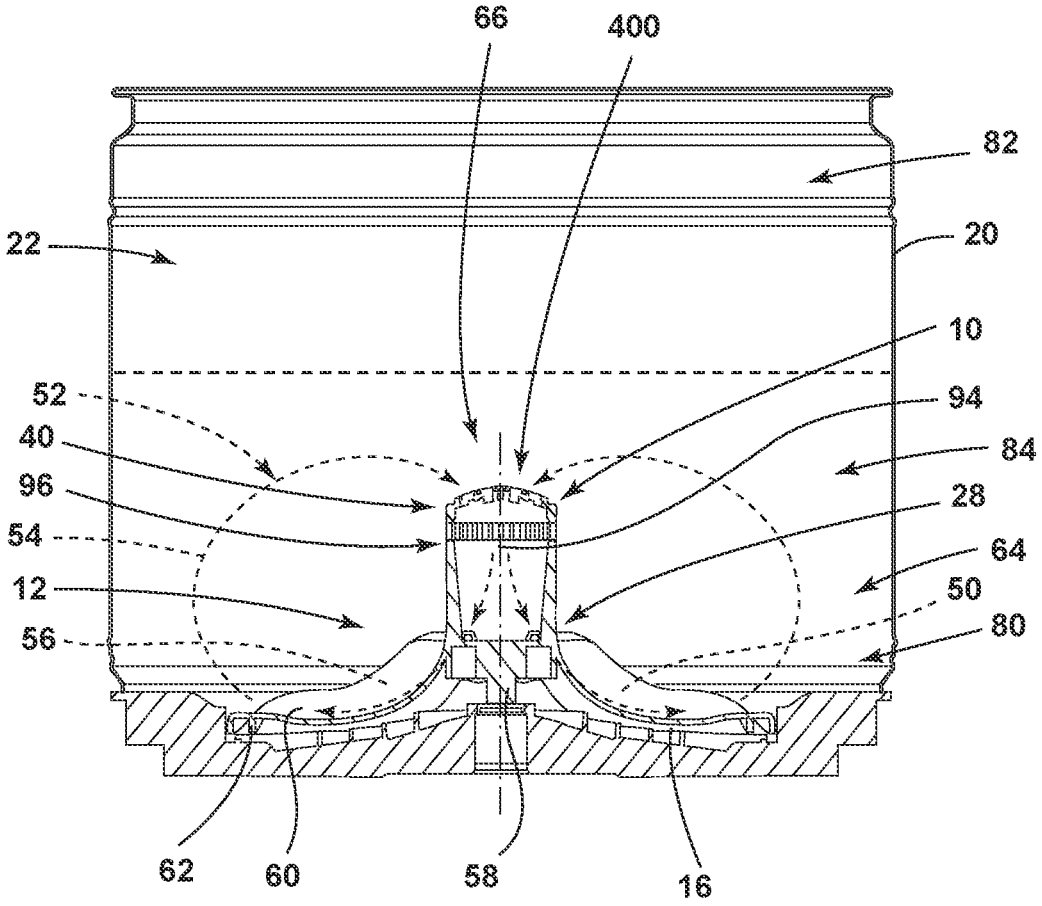
FIG. 3 is a cross-sectional view of a rotating drum for the vertical axis laundry appliance that incorporates an aspect of the filtration structure.

The components in the figures are not necessarily to scale, emphasis instead being placed upon illustrating the principles described herein.

DETAILED DESCRIPTION

The present illustrated embodiments reside primarily in combinations of method steps and apparatus components related to an impeller for a vertical axis laundry appliance having a receiver that receives a removable filtration structure for filtering particulate from process fluid within a processing space of the appliance, and where the filtration structure can include a separate agitating mechanism for assisting and processing articles within the processing space. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-38, reference numeral 10 generally designates a filtration structure that is incorporated within a rotator 12 of a vertical axis laundry appliance 14. The rotator 12, such as an impeller 16, an agitator 18, or an impeller 16 with a removable agitator 18, is disposed within a rotating drum 20 that defines a processing space 22 for treating articles. The rotating drum 20 rotates within a stationary tub 24 that is positioned within the outer cabinet 26. According to the various aspects of the device, the rotator 12 includes the impeller 16 having a receiver 28 that receives a removable agitator 18 or a removable filter cartridge 40, as will be described more fully below.

According to the various aspects of the device, as generally set forth in FIGS. 1-38, the laundry appliance 14 includes a drum 20 that is rotationally operable within the tub 24. The rotator 12 is rotationally operable relative to the drum 20. The rotator 12 includes the impeller 16 that is axially fixed with respect to the drum 20 and includes a receiver 28. A removable agitator 18 is selectively coupled with the receiver 28. The filtration structure 10 is disposed at least within the removable agitator 18. In certain aspects of the device, as will be described more fully below, the filtration structure 10 can also be disposed within the receiver 28 of the impeller 16. Also, a filter cartridge 40 can be disposed within the receiver 28 to form the filtration structure 10.

Referring now to FIGS. 1-5, the impeller 16, that is disposed within the rotating drum 20, includes various flow structures 50 that promote a toroidal flow 52 of process fluid 54 that is used for treating articles contained within the processing space 22 that is defined within the rotating drum 20. To generate this toroidal flow 52, the impeller 16 can include various flow channels 56 that are defined within the structure of the impeller 16. These flow channels 56 can extend from the receiver 28, through a central area 58 of the impeller 16, and then beneath the underside 60 of the impeller 16. During rotational operation of the drum 20 and the rotator 12 within the tub 24, various structural ribs 62 that are defined within the underside 60 of the impeller 16 operate to move the process fluid 54 within the processing space 22. This movement of the process fluid 54 through the processing space 22 is generally in the form of the toroidal flow 52 that moves from the underside 60 of the impeller 16 and around the outer areas 64 of the processing space 22. The toroidal flow 52 then continues back toward the center 66 of the processing space 22 and through the receiver 28 of the impeller 16. The toroidal flow 52 of fluid then moves from the receiver 28 and through the flow channels 56 back to the underside 60 of the impeller 16 to repeat the general form of this motion. The process fluid 54 described herein can take the form of water, water combined with certain treating consumables. These treating consumables can include detergent, fabric softener, oxi-type products, bleach, combinations thereof, and other similar products. During the course of a particular treating cycle of the appliance 14, the process fluid 54 can accumulate particulate 70, such as from the articles being processed in the processing space 22. The particulate 70 may also be present in the tub 24, or in the drum 20, or another portion of the processing space 22.

Using this toroidal flow 52, the various aspects of the filtration structure 10 operate to filter particulate 70 from the toroidal flow 52 of process fluid 54 as it moves through the filtration structure 10. In this manner, various particulate 70, such as pet hair, various soils, objects, and other forms of particulate 70 can be captured within a collection space 72 of the filtration structure 10. After completion of a particular laundry cycle, the filtration structure 10 can be separated from the impeller 16 and cleaned for later use.

Referring again to FIGS. 1-5, using the various aspects of the filtration structure 10, the impeller 16 occupies a lower area 80 of the processing space 22. The various removable agitators 18 and filter cartridges 40 that can be attached with the receiver 28 of the impeller 16 can place the filtration structure 10 at various heights within the processing space 22. As exemplified in FIGS. 1 and 2, the filtration structure 10 can be located within an upper area 82 of the processing space 22. As exemplified in FIGS. 3-5, the filtration structure 10 can be placed within a medial area 84 of the processing space 22 or within the lower area 80 of the processing space 22. Using these various forms of the filtration structure 10, certain attachments can be fitted within the receiver 28 for placing the filtration structure 10 to correspond to the size of load being processed within the processing space 22.

Referring now to FIGS. 6-22, the removable agitator 18 that is coupled with the receiver 28 can include a release mechanism 90 that is disposed within the sidewall 92 of the removable agitator 18. In this aspect of the device, the release mechanism 90 operates in the direction that is generally perpendicular to a longitudinal axis 94 of the removable agitator 18. Additionally, the filtration structure 10 is disposed within a filtration receptacle 96 that is disposed at an end 98 of a sidewall 92 and adjacent to the release mechanism 90. Accordingly, in this aspect of the device, the filtration structure 10 is positioned at an upper area 82 of the processing space 22 to capture particulate 70 within the process fluid 54. The filtration receptacle 96 receives the filtration structure 10 that includes a cap member 100 having a filtration screen 102. The filtration screen 102 is coupled with the cap member 100 and the cap member 100 is selectively removable from the filtration receptacle 96. Accordingly, between laundry cycles, the filtration structure 10 can be separated from the filtration receptacle 96 for cleaning out the various captured particulate 106. Within the filtration structure 10, the filtration screen 102 and the cap member 100 can be separated. Accordingly, the collection space 72 can be defined between the filtration screen 102 and the cap member 100 where the captured particulate 106 accumulates over the course of one or more laundry cycles. In this manner, the filtration screen 102 is selectively separable from the cap member 100 to provide access to the particulate chamber 104 contained therein.

Referring again to FIGS. 11-22, the release mechanism 90 of the removable agitator 18 includes a pin 222 that is axially operated along an operational axis 112 via operation of the release mechanism 90. The release mechanism 90 is positioned between the internal shaft 110 and the filtration structure 10. This allows the pin 222 of the release mechanism 90 to operate along the operational axis 112 that is perpendicular to the longitudinal axis 94 of the removable agitator 18. Accordingly, placement of the release mechanism 90 does not interfere with the movement of the process fluid 54 through the filtration structure 10 within the filtration receptacle 96 at the end 98 of the removable agitator 18.

As exemplified in FIGS. 12-22, the removable agitator 18 includes a structural plate 120 that is positioned between the filtration receptacle 96 and the release mechanism 90. During operation of the release mechanism 90, an angled surface 122 of the pin 222 for the release mechanism 90 engages a biasing structure 124 that is incorporated as part of, and typically within, the internal shaft 110. As the pin 222 for the release mechanism 90 is operated along the operational axis 112, the angled surface 122 pushes the biasing structure 124 in a release direction 126 along the longitudinal axis 94 and toward the structural plate 120 and away from the receiver 28. Through this movement, the internal shaft 110 is moved in the release direction 126 and an engagement section 128 of the internal shaft 110 is separated from the receiver 28 so that the removable agitator 18 can be released from the receiver 28 and taken out of the processing space 22.

The structural plate 120 disposed within the removable agitator 18 provides a surface structure against which a biasing mechanism can operate to bias the internal shaft 110 in a return direction 140, which opposes the release direction 126. The return direction 140 is toward the engagement section 128 of the removable agitator 18, which typically opposes the end 98 of the sidewall 92 of the removable agitator 18. Accordingly, operation of the release mechanism 90 exerts biasing forces against the structural plate 120 and does not interfere with the filtration screen 102 of the filtration structure 10, which is positioned on an opposing side of the structural plate 120. Additionally, the structural plate 120 includes a plurality of plate openings 150 that define part of an internal flow space 152 within the sidewall 92. This internal flow space 152 permits passage of filtered process fluid 154 from the filtration structure 10. This filtered process fluid 154 proceeds through the removable agitator 18 and into the receiver 28. From there, the filtered process fluid 154 proceeds through the flow channels 56 of the impeller 16 and is directed back into the processing space 22.

According to the various aspects of the device, the base 160 of the internal shaft 110 defines the engagement section 128 of the removable agitator 18 that is received within the receiver 28 of the impeller 16. The internal flow space 152 of the removable agitator 18 is defined between the sidewall 92 of the agitator 18 and the internal shaft 110 and the internal flow space 152 directs filtered process fluid 154 around the internal shaft 110 and through the engagement section 128 and the receiver 28. It is contemplated that the sidewall 92 of the removable agitator 18 can include various wall openings 162 through which certain amounts of the filtered process fluid 154 can be directed back into the processing space 22 during a laundry cycle. Through this configuration, the removable agitator 18 can generate a multi-directional movement of process fluid 54, including the filtered process fluid 154, through the processing space 22. These complex movements of the process fluid 54 through the processing space 22 can assist in treating articles contained within the processing space 22.

Referring again to FIGS. 12-22, the filtration structure 10 at the end 98 of the removable impeller 16 can attach to the filtration receptacle 96 through various attachment mechanisms 170. These attachment mechanisms 170 can include, but are not limited to, twist-lock features, detents, clasps, mating features, interference mechanisms, mechanical fasteners, a threaded interface, and other similar attachment methods and mechanisms. The cap member 100 of the filtration structure 10 can include various filter openings 172 that provide for movement of process fluid 54 into the particulate chamber 104 of the filtration structure 10. These filter openings 172 can be positioned along a top surface 174 and a side surface 176 of the cap member 100. In this manner, process fluid 54, including particulate 70, can enter into the particulate chamber 104 through various directions to be filtered by the filtration screen 102. The filtration screen 102 typically has a mesh size that is sufficient to capture a range of sizes of particulate 70, such as medium to fine particulate 70 as an example, as described herein.

Referring now to FIGS. 15-22, the release mechanism 90 is configured to operate to move the internal shaft 110 a sufficient distance to disengage the base 160 of the internal shaft 110 from the receiver 28 of the impeller 16. At the same time, the path of travel of the pin 222 for the release mechanism 90 is intended to be sufficiently minimal to provide for ease of use by a user. Also, the interaction between the angled surface 122 of the pin 222 of the release mechanism 90 and the biasing structure 124 of the internal shaft 110 is configured to provide a certain level of resistance, such that the release mechanism 90 can resist inadvertent operation by articles being processed within the rotating drum 20. Accordingly, the release mechanism 90 includes a shoulder wall 180 that surrounds a portion of the release mechanism 90 to prevent inadvertent operation of the release mechanism 90.

It is contemplated that the release mechanism 90 can be placed under a grasping structure of the removable impeller 16. Such a grasping structure can also double as one of the helical formations 190 that extend around the outer surface 192 of the sidewall 92 of the removable agitator 18. Accordingly, when the user desires to remove a removable agitator 18 from the impeller 16, the user can grasp the grasping structure of the sidewall 92 and, contemporaneously, also engage the release mechanism 90 that operates the internal shaft 110. This grasping motion can operate to disengage the base 160 of the internal shaft 110 from the receiver 28 of the impeller 16 and also allow the user to grasp and lift the removable agitator 18 from the receiver 28. In this manner, the release mechanism 90 is surrounded by the shoulder wall 180 to prevent inadvertent operation of the release mechanism 90 by articles contained within the processing space 22, but also allow a user convenient access to the release mechanism 90.

According to various aspects of the device, the release mechanism 90 can take the form of a lever, button, slider, or other similar mechanism that can operate the angled surface 122 of the release mechanism 90 relative to the biasing structure 124. Additionally, an axial and linear motion of the release mechanism 90 along the operational axis 112 is contemplated herein. It should be understood that the release mechanism 90 disposed within the sidewall 92 can also utilize other types of motion, such as rotational, angular, sliding, and combinations thereof, to disengage the removable agitator 18 from the receiver 28.

Referring now to FIGS. 17-22, the structural plate 120 and an upper section 210 of the internal shaft 110 include biasing formations 212 that are configured to secure a biasing mechanism therebetween. Such a biasing mechanism, typically in the form of a spring, operates to bias the internal shaft 110 toward the base 160 of the removable agitator 18, such as in the return direction 140. In this manner, when the removable agitator 18 is placed within the receiver 28 in an installed position 214, the biasing mechanism that extends between the internal shaft 110 and the structural plate 120 biases the internal shaft 110 in the return direction 140 and toward the receiver 28 to maintain a secure engagement in the installed position 214. The biasing force of this biasing mechanism is overcome through operation of the release mechanism 90 that biases the internal shaft 110 in the release direction 126 and toward the structural plate 120. Accordingly, operation of the release mechanism 90 and the movements of the internal shaft 110 and the biasing mechanism are absorbed by the structural plate 120 such that these forces are not transferred into the filtration structure 10 of the removable agitator 18.

Referring again to FIGS. 12-22, it is also contemplated that the filtration structure 10 that is positioned within the filtration receptacle 96 at the end 98 of the removable agitator 18 is separately removable from the removable agitator 18. Accordingly, a user can separate the filtration structure 10 from the removable agitator 18 without also removing the removable agitator 18 from the receiver 28. Accordingly, maintenance of the filtration structure 10 can be accomplished without detaching the removable agitator 18 from the impeller 16.

Referring now to FIGS. 17-22, the release mechanism 90 can include the pin 222 that operates in an axial direction and along the operational axis 112 that is perpendicular to the longitudinal axis 94 of the removable agitator 18. The pin 222 includes the angled surface 122 that interacts with the biasing structure 124 of the internal shaft 110. In this manner, the angled surface 122 of the pin 222 extends through an operational opening 234 of the internal shaft 110. This operational opening 234 allows the angled surface 122 to reach the biasing structure 124 that can be disposed within the internal shaft 110. By placing the release mechanism 90 in this location and in this orientation, the filtration structure 10 can be located at the end 98 of the removable agitator 18. The release mechanism 90 includes a structural sleeve 220 that attaches to the sidewall 92 of the removable agitator 18. The pin 222 is positioned within the structural sleeve 220. This pin 222 operates between an extended position 224 and defines an idle state 226 of the release mechanism 90 and, an inserted position 228 that defines a release position 230 of the release mechanism 90. The biasing mechanism is disposed between the structural sleeve 220 and the pin 222. This biasing mechanism biases the pin 222 to the extended position 224 and the idle state 226.

It is contemplated that the biasing mechanism that is contained within the structural sleeve 220 and the biasing mechanism that is contained between an internal shaft 110 and the structural plate 120 can be calibrated to require a certain minimum amount of force to be applied to an actuating portion 232 of the pin 222 of the release mechanism 90 for disengaging the removable agitator 18 from the receiver 28 of the impeller 16. Additionally, it is contemplated that the path of travel of the pin 222 with respect to the structural sleeve 220 can be relatively minimal. Through this configuration, the actuating portion 232 of the release mechanism 90 can be relatively hidden within the shoulder wall 180. The minimal path of travel can allow for operation of the release mechanism 90 without having to reach a significant distance within the shoulder wall 180 to operate the actuating portion 232 of the release mechanism 90.

In certain aspects of the device, the path of travel of the pin 222 can be within a range of from approximately 20 millimeters to approximately 10 millimeters. Additionally, the path of travel can be within a range of from approximately 5 millimeters to approximately 10 millimeters. The path of travel of the release mechanism 90 can be within a range of from approximately 15 millimeters to approximately 25 millimeters.

Referring again to FIGS. 12-18, the filtration structure 10 can include the cap member 100 that includes an attachment surface 240 along an outer surface 242 of the cap member 100. As described herein, this attachment surface 240 operates to engage the sidewall 92 of the removable agitator 18 to attach the filtration structure 10 to the removable agitator 18. The filtration screen 102 can also engage an engaging surface 244 that interacts with an inside surface 246 of the cap member 100. This interaction can be used to secure the filtration screen 102 to the cap member 100. Accordingly, the outer surface 242 of the cap member 100 is used to secure the filtration structure 10 to the end 98 of the sidewall 92. Contemporaneously, the inside surface 246 of the cap member 100 is used to receive the filtration screen 102 to form the particulate chamber 104 that collects the captured particulate 106.

Referring now to FIGS. 3 and 23-29, the laundry appliance 14 includes the drum 20 that is rotationally operable within the tub 24. The rotator 12 is rotationally operable relative to the drum 20. The rotator 12 includes the impeller 16 that is axially fixed with respect to the drum 20 and includes the receiver 28. A removable cassette 260 is selectively coupled with the receiver 28. The filtration structure 10 is disposed at least within the receiver 28 of the impeller 16. According to the various aspects of the device, the removable cassette 260 can be in the form of a removable agitator 18 and/or a removable filter 262. Additionally, the removable agitator 18 and the removable filter 262 can be separate components that are alternatively implemented by the user depending upon the size of the load and the desired laundry cycle being performed on the laundry appliance 14.

Referring again to FIGS. 3 and 23-29, the removable filter 262 includes a filter wall 270 and a filter cup 272 that cooperate with the receiver 28 to define a portion of the filtration structure 10. The filter wall 270 is selectively attached to the receiver 28 to define the installed position 214 of the removable filter 262. In the installed position 214, the removable filter 262 is typically positioned within a lower area 80 of the processing space 22 or can extend from the lower area 80 of the processing space 22 up through the medial area 84 of the processing space 22 as well as through the upper area 82 of the processing space 22. The size of the removable filter 262 can vary depending upon the design of the appliance 14, the laundry cycle being performed, and the desired filtering capabilities to be utilized within the appliance 14.

As exemplified in FIGS. 23-29, the filtration structure 10 includes a first set 280 of apertures 282 that are defined within a receiver wall 284 of the receiver 28. A second set 286 of apertures 282 are defined within a filter wall 270 of the removable filter 262. The first set 280 of apertures 282 align with a second set 286 of apertures 282 when the removable filter 262 is in the installed position 214. Accordingly, in the installed position 214, the first set 280 and second set 286 of apertures 282 allow for movement of process fluid 54 from the processing space 22 and into the removable filter 262 via the receiver wall 284 of the receiver 28. This directs the process fluid 54 into the particulate chamber 104 defined within the removable filter 262.

As described herein, as the process fluid 54 moves through the removable filter 262 and the particulate chamber 104 thereof, filtered process fluid 154 moves according to the toroidal flow 52 through the filter cup 272 and then through the flow channels 56 defined within the impeller 16. In this manner, captured particulate 106 accumulates within the removable filter 262. At the conclusion of each laundry cycle or number of laundry cycles, the removable filter 262 can be separated from the receiver 28. The removable filter 262 includes an access aperture 290 within the filter wall 270 of the removable filter 262. The access aperture 290 is typically large enough to allow a user to fit their hand or one or more fingers into the particulate chamber 104 to remove the captured particulate 106. Various tools or cleaning implements can also be used to remove the captured particulate 106 from the particulate chamber 104. In certain aspects of the device, the filter cup 272 can be separated from the filter wall 270 such that the filter cup 272 can be cleaned and reattached to the filter wall 270.

Referring again to FIGS. 23-29, the removable filter 262 includes a locking tab 300 that is positioned within a deflecting portion 302 of the filter wall 270. The locking tab 300 operates to selectively engage a locking recess 304 within the receiver wall 284 of the receiver 28. Through this configuration, the removable filter 262 can be inserted into the receiver 28 and a locking tab 300 can engage the locking recess 304 to secure the removable filter 262 in the installed position 214. As the filter is moved into the installed position 214, the deflecting portion 302 of the removable filter 262 can deflect inward to allow the locking tab 300 to bypass sections of the receiver 28. When the locking tab 300 is aligned with the locking recess 304 of the receiver 28, the deflecting portion 302 is allowed to deflect outward such that the locking tab 300 engages the locking recess 304 to secure the removable filter 262 in the installed position 214.

Figure 27:
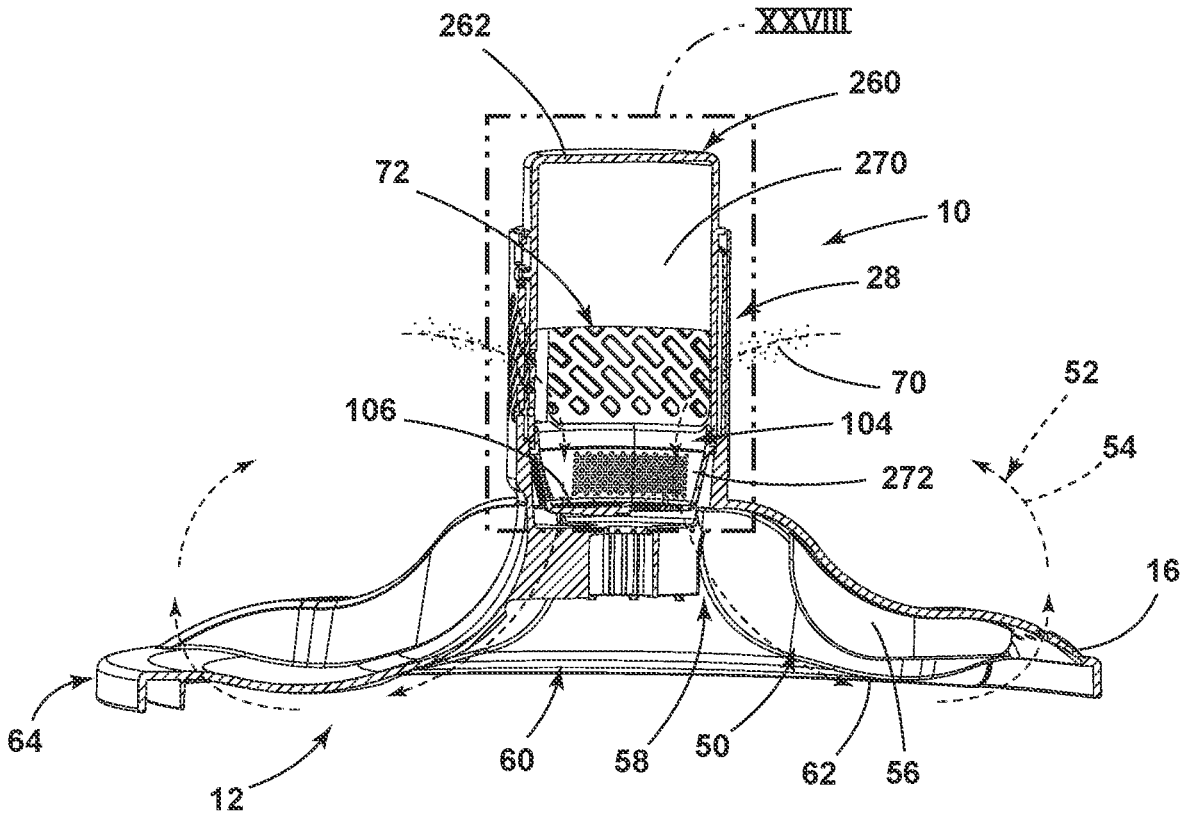
FIG. 27 is a cross-sectional view of the impeller of FIG. 25 taken along the line XXVII-XXVII and showing the filtration structure in the installed position.
Figure 28:
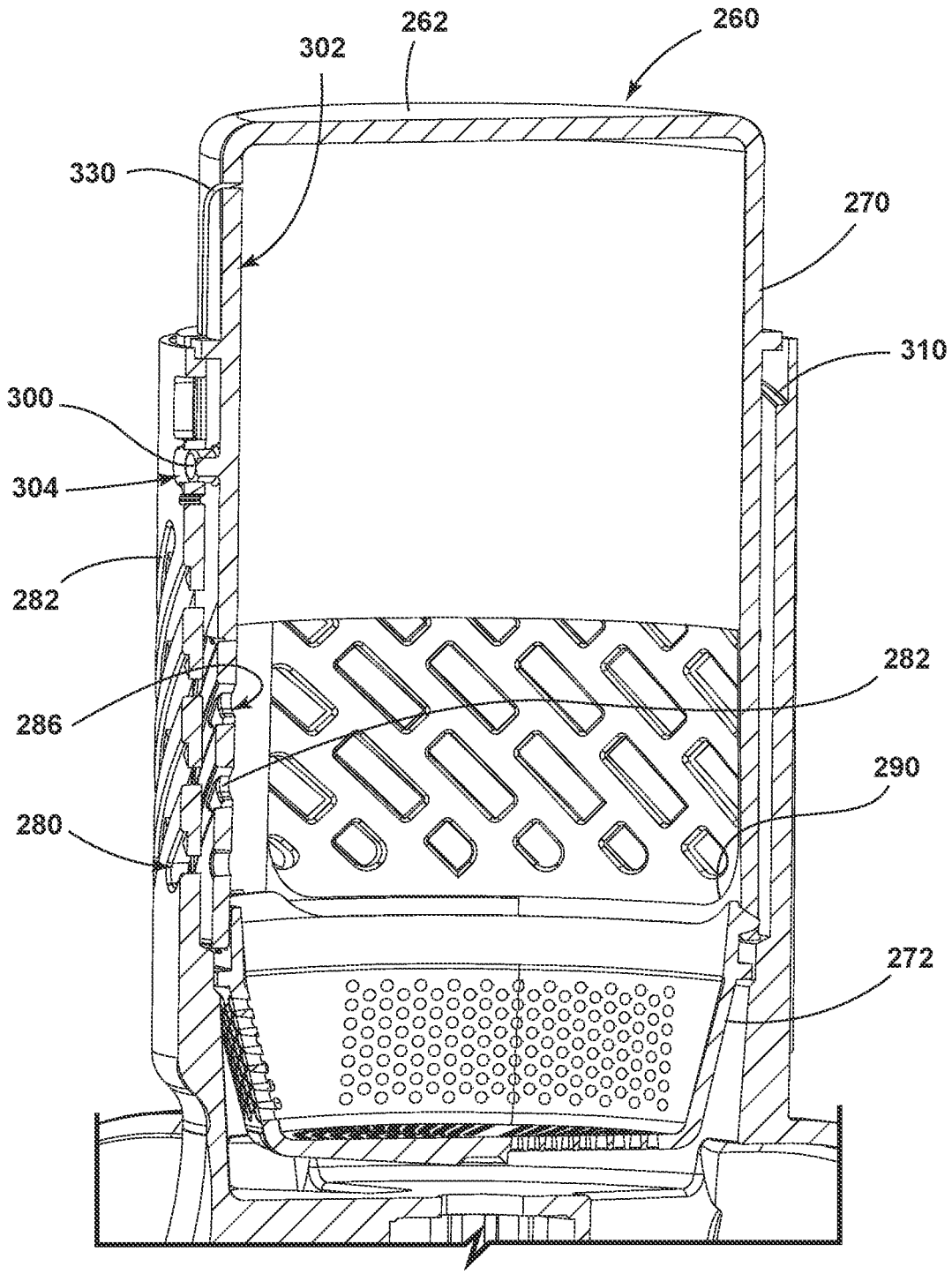
FIG. 28 is an enlarged cross-sectional view of the filtration structure of FIG. 27 taken at area XXVIII.
Figure 29:
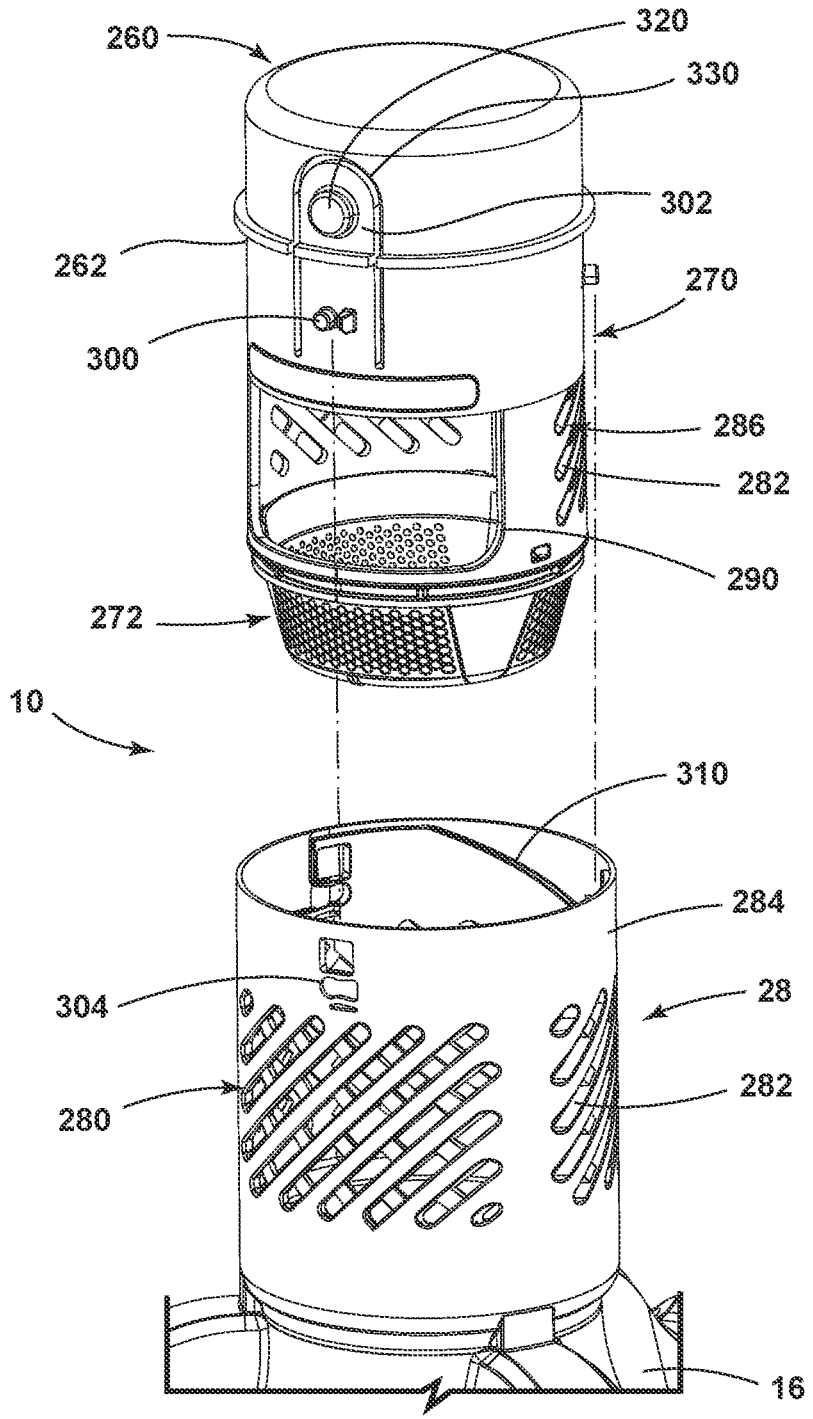
FIG. 29 is an exploded perspective view of the filtration structure of FIG. 23 and showing the filter cartridge separated from the receiver of the impeller.
Figure 30:
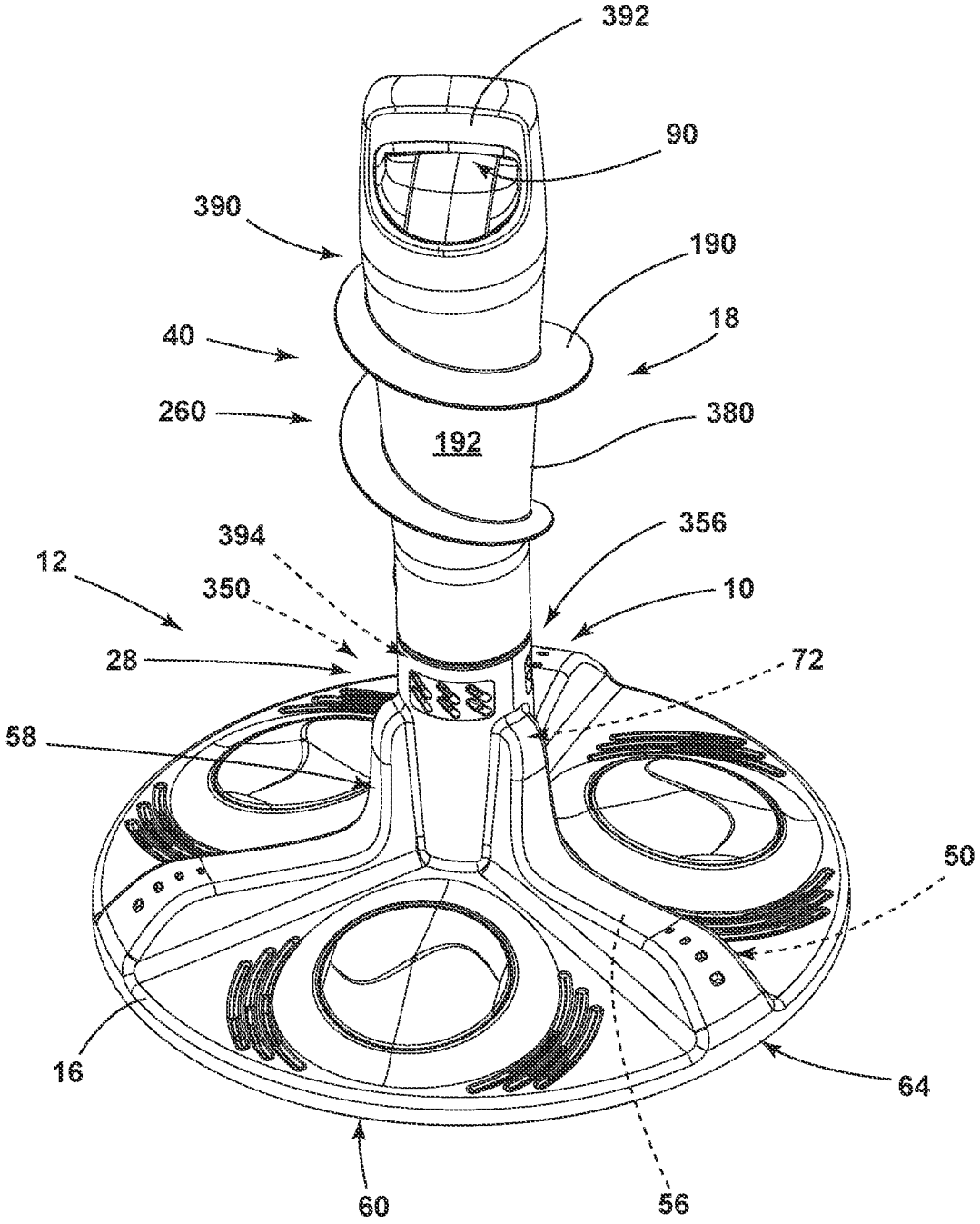
FIG. 30 is a side perspective view of an impeller and a removable agitator with an aspect of the filtration structure disposed within the receiver of the impeller.
Figure 31:
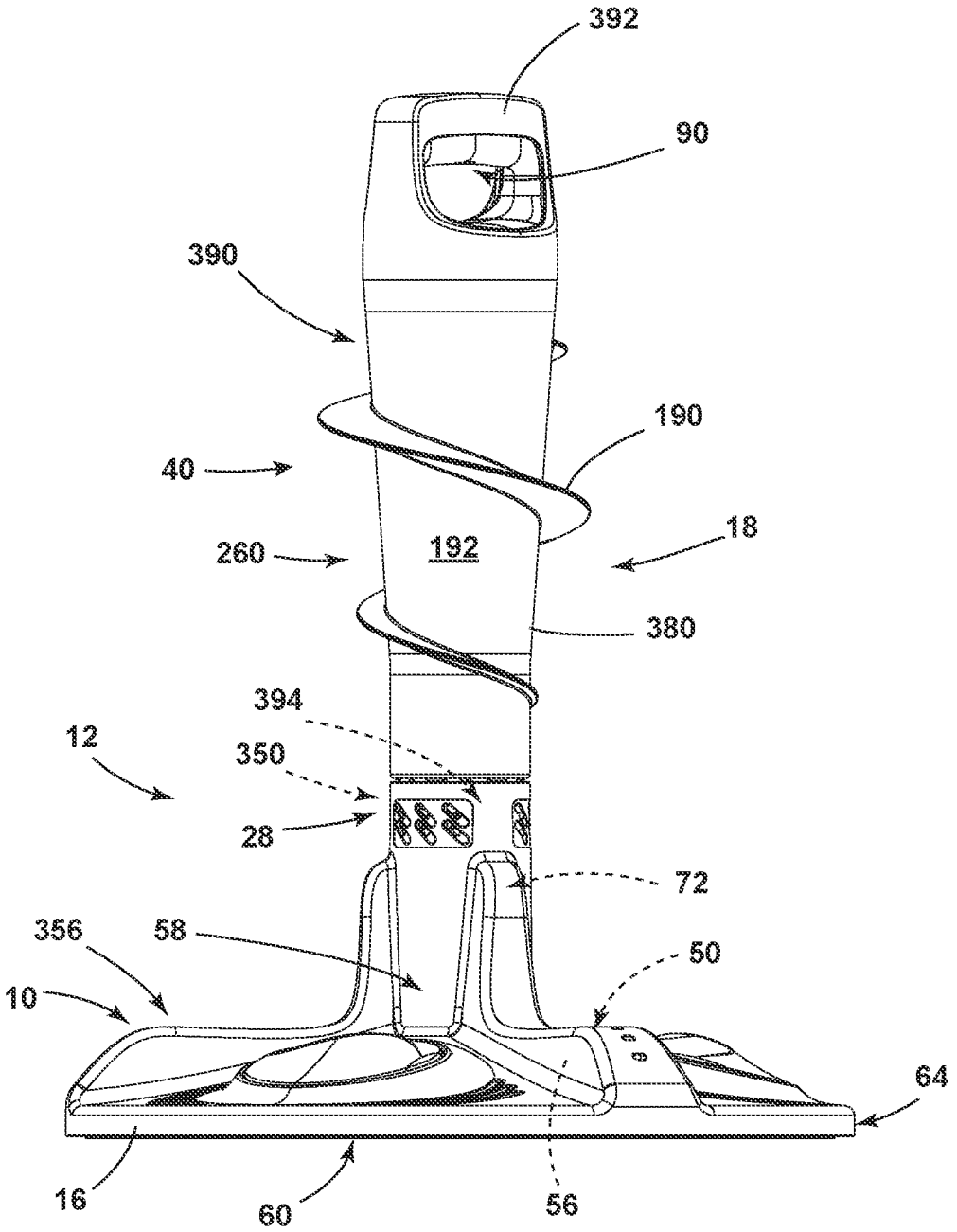
FIG. 31 is a side elevational view of the impeller and the removable agitator of FIG. 30.
Figure 32:
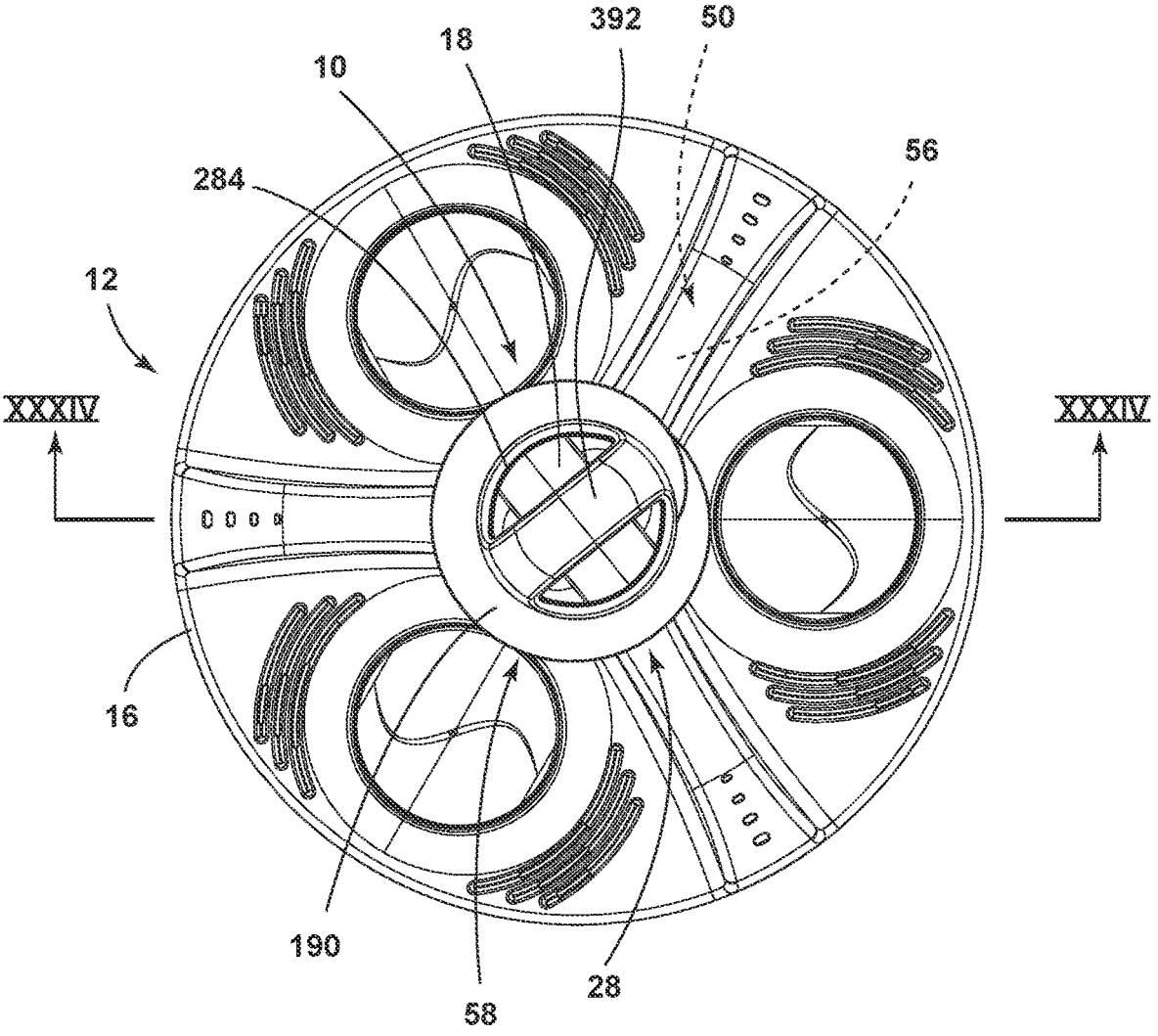
FIG. 32 is a top plan view of the impeller and the removable agitator of FIG. 30.
Figure 33:
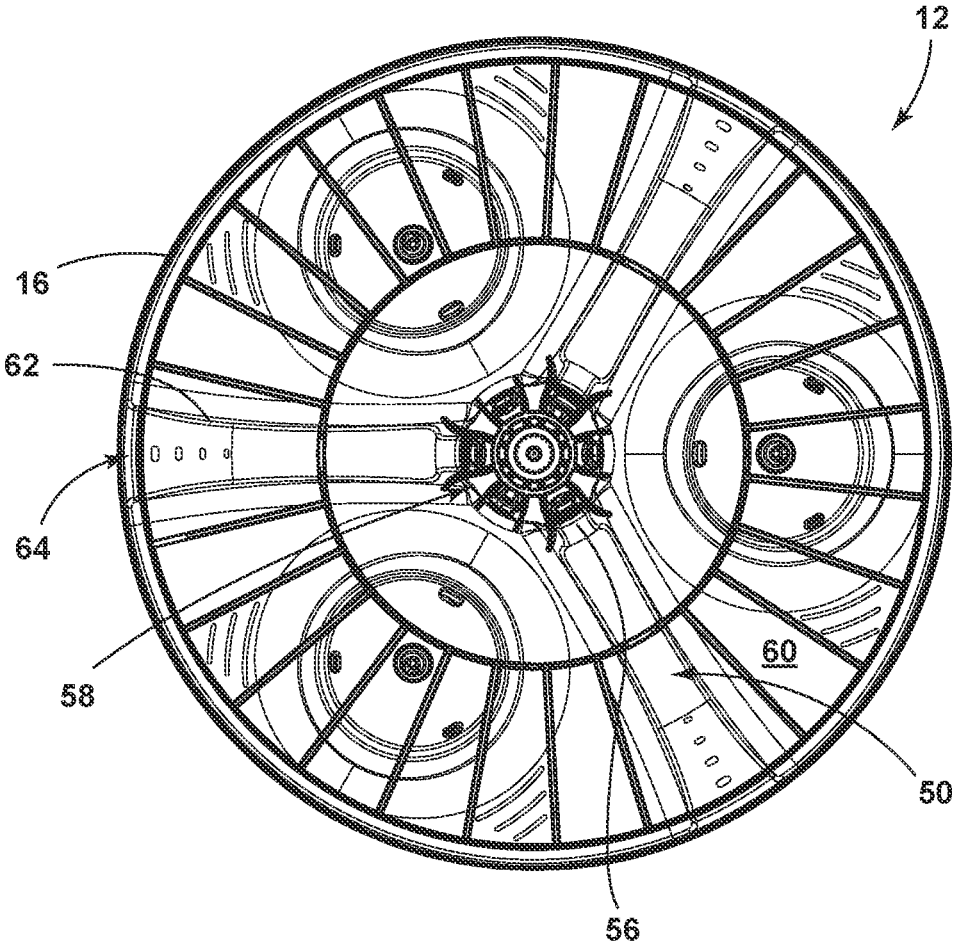
FIG. 33 is a bottom plan view of the impeller of FIG. 30.
Figure 34:
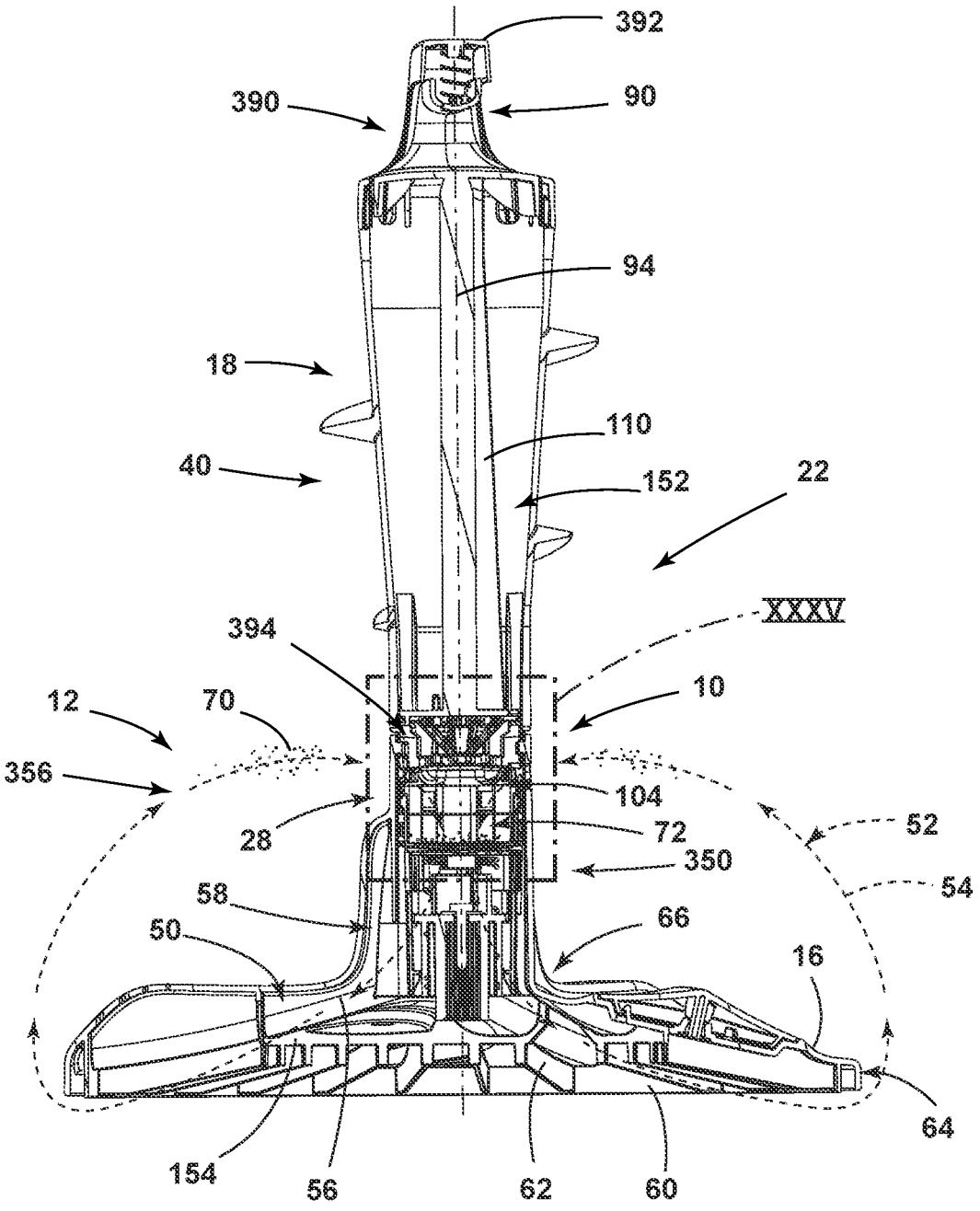
FIG. 34 is a cross-sectional view of the impeller and the removable agitator of FIG. 32 taken along the line XXXIV-XXXIV.
Figure 35:
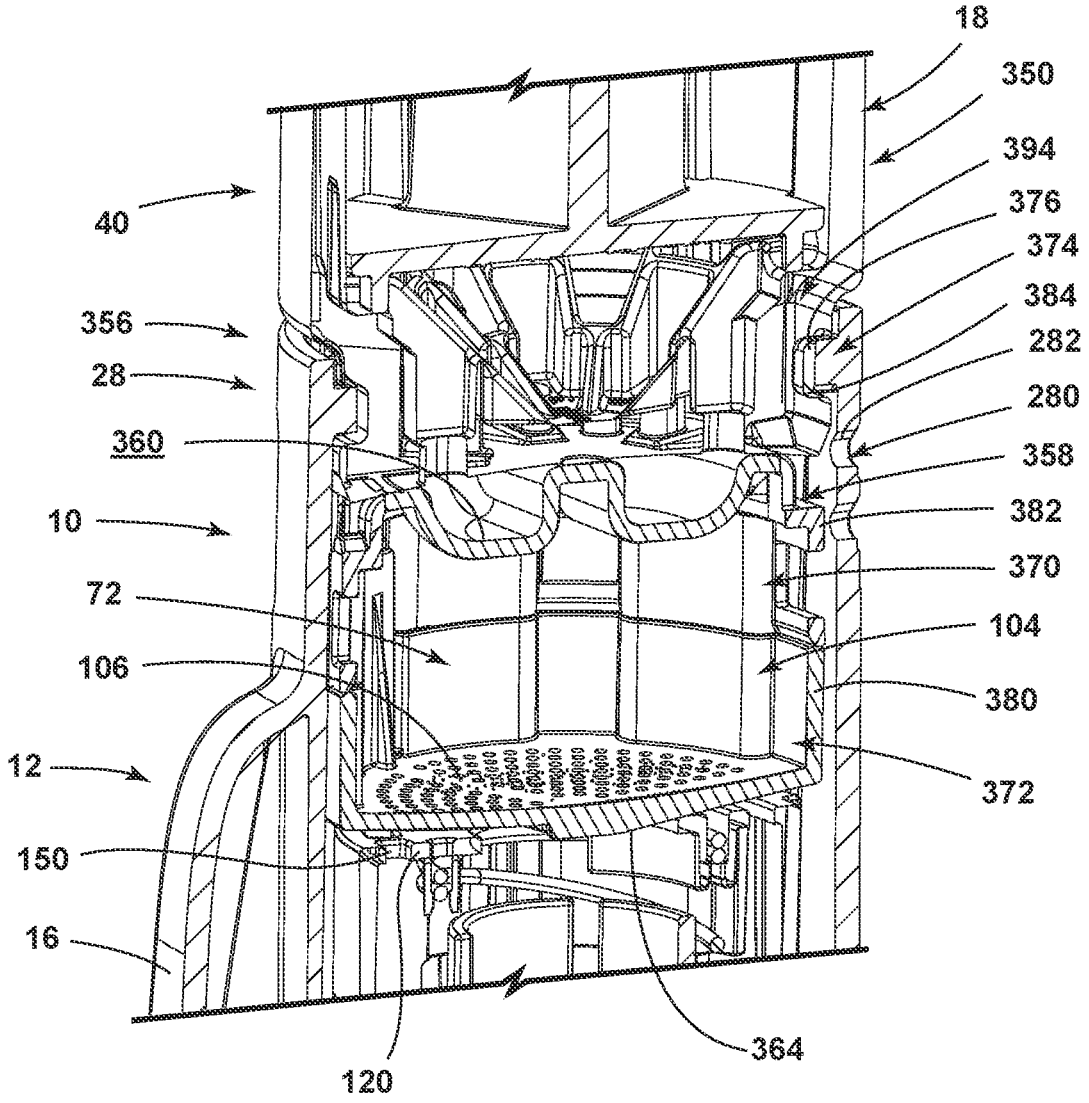
FIG. 35 is an enlarged cross-sectional view of the impeller of FIG. 34 taken at area XXXV and showing engagement of the removable agitator with the receiver in a filter cartridge in a first filtering position.
Figure 36:
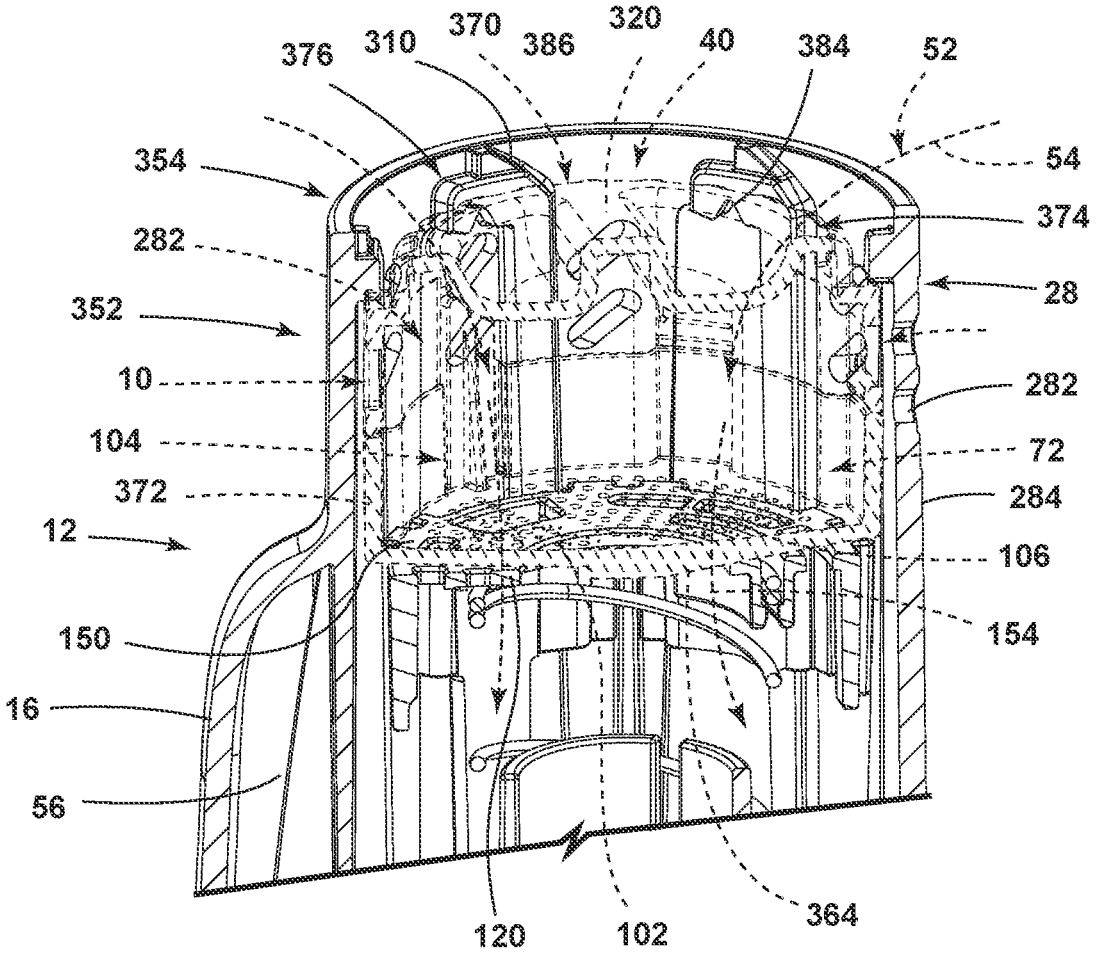
FIG. 36 is a cross-sectional view of the impeller of FIG. 35 and showing a filter cartridge moved to a second filtering position when the removable agitator is separated from the receiver.
Figure 37:
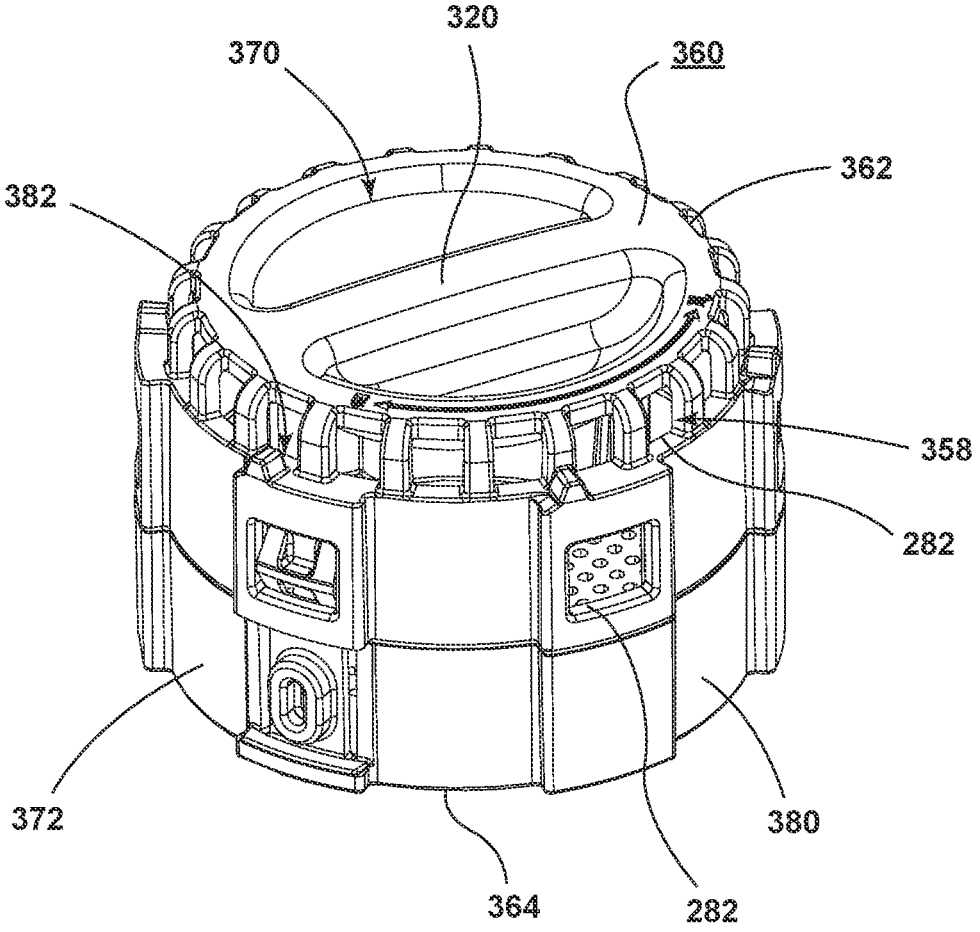
FIG. 37 is a side perspective view of the filter cartridge of FIG. 35.
Figure 38:
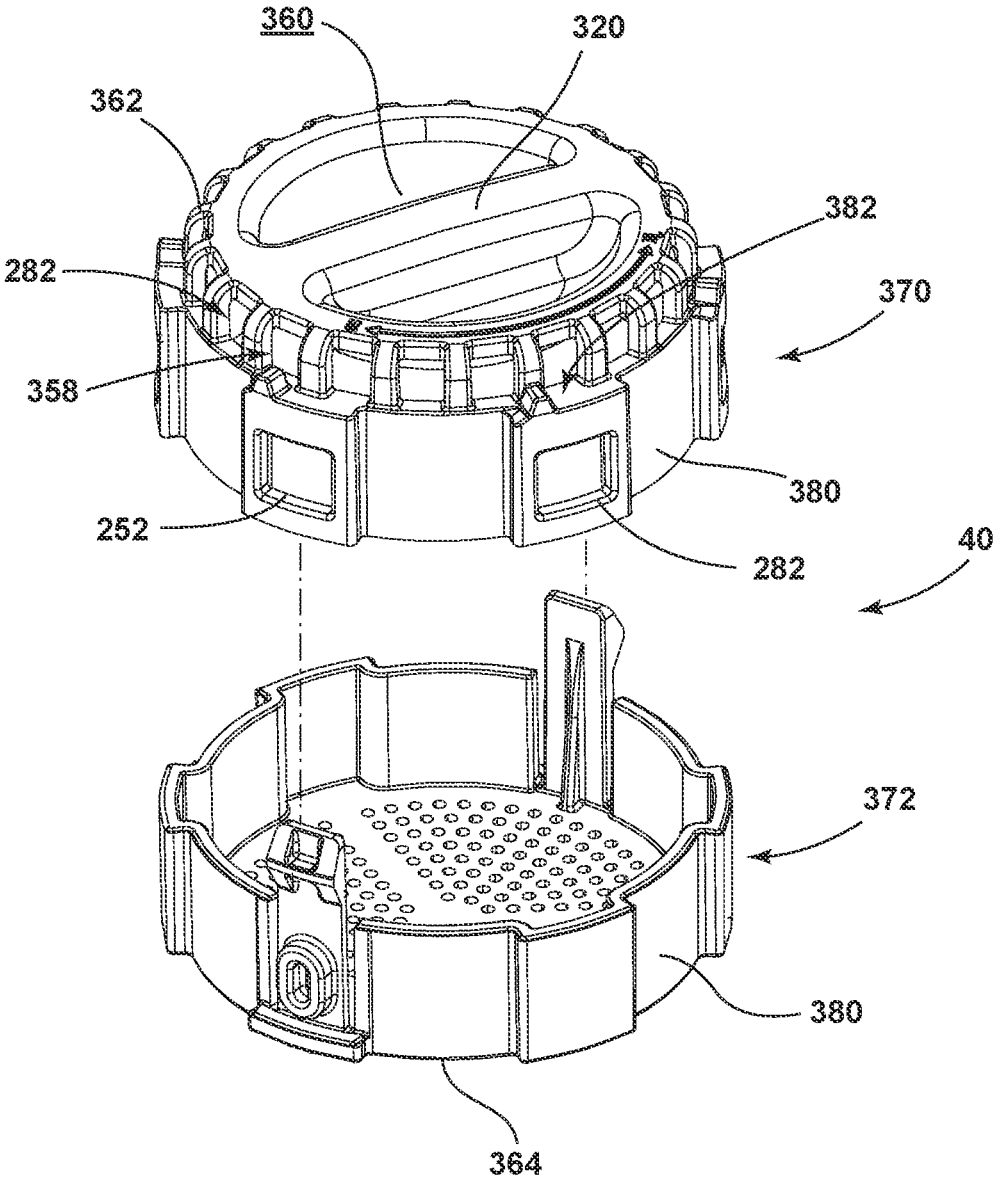
FIG. 38 is an exploded perspective view of the filter cartridge of FIG. 37.

As exemplified in FIGS. 27-29, the receiver 28 can include an angled guide 310 that interacts with the locking tab 300 to provide for a twist-lock configuration that moves the removable filter 262 into the installed position 214. As the removable filter 262 is installed into the receiver 28, the angled guide 310 can include an incline that guides the locking tabs 300 within the receiver 28 to arrive at the installed position 214. Accordingly, the angled guide 310 of the receiver 28 allows for the removable filter 262 to be inserted within the receiver 28 in any rotational orientation. The angled guide 310 of the receiver 28 will guide the locking tab 300 of the removable filter 262 along the slope of the angled guide 310 and into the installed position 214 such that the locking tab 300 can engage the locking recess 304. This configuration of the angled guide 310 can also serve as a twist-lock configuration that secures the removable filter 262 in the installed position 214.

Referring again to FIGS. 27-29, the filter wall 270 of the removable filter 262 can include a grasping feature 320 that is included within the deflecting portion 302 of the filter wall 270. Engagement of the grasping feature 320 can be used to operate the deflecting portion 302 to deflect inward relative to the receiver 28. The inward deflection of the deflecting portion 302 serves to bias the locking tab 300 into the particulate chamber 104. This inward deflection of the locking tab 300 serves to disengage the locking tab 300 from the locking recess 304. Once disengaged, the removable filter 262 can be pulled out from the receiver 28 for cleaning or replacement.

Referring again to FIGS. 27-29, the locking tab 300 can include a multi-part tab or uniquely shaped tab that fits within the locking recess 304 to secure the removable filter 262 in the installed position 214. Additionally, the deflecting portion 302 of the filter wall 270 can include a section of the filter wall 270 having a cutout 330 that surrounds the deflecting portion 302. This cutout 330 allows for movement of the deflecting portion 302 toward the particulate chamber 104. In this configuration, the deflecting portion 302 is defined by an enlarged tab that is defined within the filter wall 270. This enlarged tab provides for a convenient system for a user to operate the deflecting portion 302 to install and remove the removable filter 262 from the receiver 28.

As exemplified in FIGS. 27-29, the removable filter 262 can include a plurality of locking tabs 300 that interact with a corresponding number of locking recesses 304 of the receiver 28. As described herein, this configuration provides for a number of orientations that the removable filter 262 can be installed within the receiver 28. Additionally, the filter wall 270 can include a set of locking tabs 300 that provides for engagement between the filter cup 272 and the filter wall 270. Through this configuration, as described herein, the filter cup 272 can be separated from the filter wall 270 for convenient cleaning of the filter cup 272 and the filter wall 270 after completion of a particular laundry cycle.

According to various aspects of the device, the filter wall 270 can include a plurality of apertures 282, such as the second set 286 of apertures 282, within the filter wall 270. As exemplified in FIGS. 27-29, the receiver 28 also includes the first set 280 of apertures 282 that cooperate with the second set 286 of apertures 282 to form a portion of the filtration structure 10. It is contemplated that the receiver 28 can be a low-profile member that includes the locking recesses 304 for receiving the removable filter 262 in the installed position 214. It is further contemplated the receiver 28 may not include apertures 282 such that the apertures 282 of the filtration structure 10 are included within the removable filter 262 itself. The use of the first and second sets 280, 286 of apertures 282 within the receiver 28 and the filter wall 270 can provide for additional layers of filtration within the filtration structure 10 that can capture larger particulate 70 before entering the particulate chamber 104 of the removable filter 262.

As exemplified in FIGS. 23-29, the receiver 28 can include the receiver wall 284 that includes the first set 280 of apertures 282 as well as the locking recesses 304. This receiver wall 284 provides additional structure and stability to the filtration structure 10 of the impeller 16 and the removable filter 262 or the removable agitator 18. Accordingly, the use of the receiver wall 284 can be utilized for securing the removable cassette 260 in the installed position 214. This is true whether the removable cassette 260 is a removable filter 262, a removable agitator 18, or a combination thereof.

Referring now to FIGS. 1-5 and 30-38, the laundry appliance 14 includes a drum 20 that is rotationally operable within a tub 24. The rotator 12 is rotationally operable relative to the drum 20. The rotator 12 includes the impeller 16 that is axially fixed with respect to the drum 20 and includes the receiver 28. The removable agitator 18 is selectively received within the receiver 28. The filtration structure 10 is defined within the receiver 28 and is operable between a first filtering position 350 characterized by the removable agitator 18 being in the installed position 214, and a second filtering position 352 characterized by the removable agitator 18 being separated from the receiver 28. In this manner, the filtration structure 10 is fully defined within the impeller 16 and includes a filter cartridge 40 that moves between a top filter direction 354 and a side filter direction 356.

Referring again to FIGS. 30-38, the filter cartridge 40 is biased in an upward direction by a structural plate 120 that is upwardly biased by a biasing mechanism, such as a spring. The structural plate 120 engages the bottom surface 364 of the filter cartridge 40 and continually biases the filter cartridge 40 toward the second filtering position 352. The structural plate 120 also includes plate openings 150 that allow the filtered process fluid 154 leaving the filter cartridge 40 to move toward the flow structures 50 of the impeller 16. In this top filter direction 354, which typically corresponds to the second filtering position 352, process fluid 54 is directed through a top set 358 of filtering apertures 282 that are defined within a top surface 360 or a top edge 362 of the filter cartridge 40. Also, in the top filter direction 354, the filter cartridge 40 at least partially blocks, or otherwise interferes with, the apertures 282 that are defined within the receiver wall 284 of the impeller 16.

As described herein, this top filter direction 354 is utilized when the removable agitator 18 is separated from the receiver 28. The side filter direction 356 is characterized when the removable agitator 18 is coupled with the receiver 28. In this side filter direction 356, which corresponds to the first filtering position 350, the removable agitator 18 is coupled with the receiver 28 and engages the top surface 360 of the filter cartridge 40. When in the installed position 214, the removable agitator 18 biases the filter cartridge 40 in a downward direction such that the top set 358 of apertures 282 of the filter cartridge 40 are located even with or below the apertures 282 defined within the receiver wall 284 of the impeller 16. Accordingly, when the removable agitator 18 is in the installed position 214, the process fluid 54 is able to move into the receiver 28 through the apertures 282 and the receiver wall 284. Once within the receiver 28, the process fluid 54 is able to move, according to the toroidal flow 52 of fluid, through the top set 358 of apertures 282 in the filter cartridge 40 and into the particulate chamber 104 of the filter cartridge 40. The particulate 70 is captured within the particulate chamber 104 and the filtered process fluid 154 then moves through a filter screen of the filter cartridge 40 and then into the flow channels 56 defined within the impeller 16.

As discussed herein, the motion of the process fluid 54 is generated through the toroidal flow 52 of the process fluid 54 within the processing space 22, where the toroidal flow 52 is generated through the operation of the impeller 16 within the drum 20, and through operation of the drum 20 within the tub 24. The receiver 28 includes a biasing mechanism, typically in the form of a spring, that biases the filter cartridge 40 to the top of the receiver wall 284, also referred to herein as the second filtering position 352.

Referring again to FIGS. 35-38, the filter cartridge 40 can include a cap 370 and a filter member 372 that is attached to the cap 370. The cap 370 includes the top set 358 of apertures 282 defined within a top surface 360 and/or the top edge 362 of the filter cartridge 40. The filter member 372 includes the filter screen that is attached to the cap 370. In this manner, the filter member 372 couples with the cap 370 to form the particulate chamber 104 therein. The cap 370 and the filter member 372 are separable from one another for accessing and cleaning of the filter cartridge 40 after completion of one or more processing cycles. The cap 370 and the filter member 372 can include various engaging mechanisms for securing these components together to form the filter cartridge 40. These mechanisms can be similar to those described herein with respect to the various filtration structures 10 of the aspects of the device.

Referring again to FIGS. 35-38, the receiver 28 can include cartridge receptacle 374 that receives the filter cartridge 40. The cartridge receptacle 374 can include a plurality of abutment structures 376 that hold the filter cartridge 40 in the side filtering position 356 when the agitator 18 is removed. As discussed herein, a biasing mechanism biases the filter cartridge 40 toward the abutment structures 376. The filter cartridge 40 includes corresponding tabs 382 that selectively engage recesses 384 in the abutment structures 376. The filter cartridge 40 can be removed from the receiver 28 through a push-twist motion that allows the tabs 382 to bypass the recesses 384 as well as the abutment structures 376. This motion aligns the tabs 382 between the abutment structures 376 and along a removal path 386 that allows the biasing mechanism to bias the filter cartridge 40 at least partially out of the receiver 28. In this configuration, the abutment structures 376 can have a generally "⌈" shape that can receive the tabs 382 of the filter cartridge 40 and secure the filter cartridge 40 in the receiver 28. This generally "⌈" shape, as described herein, also defines the removal path 386 that allows the filter cartridge 40 to be removed from the receiver 28. The top surface 360 of the filter cartridge 40 can include a grasping feature 320 to allow the user to push, twist and grab the filter cartridge 40 with respect to the receiver 28. The abutment structures 376 can also include an angled guide 310 that guides the filter cartridge 40 toward the removal path 386 for installation of the filter cartridge 40 into the cartridge receptacle 374 where the tabs 382 are engaged with the recesses 384 if the abutment structures 376.

Referring again to FIGS. 32-38, the filter cartridge 40 includes a substantially solid outer wall 380 that is generally free of apertures 282. Through this configuration, the filter cartridge 40, in the second filtering position 352, can obstruct, or otherwise interfere with, the apertures 282 of the receiver wall 284 such that fluid is directed in the top filtering direction and through the top of the receiver 28 and into the top set 358 of apertures 282 of the filter cartridge 40 for being processed within the particulate chamber 104. When the removable agitator 18 is coupled with the receiver 28, the receiver 28 biases the filter cartridge 40 downward such that the outer wall 380 of the filter cartridge 40 is moved below the apertures 282 of the receiver wall 284. As described herein, once the outer wall 380 is below the apertures 282 of the receiver 28, process fluid 54 is able to enter into the interior section of the receiver 28 and through the top set 358 of apertures 282 of the filter cartridge 40 for being filtered within the processing chamber. As the process fluid 54 moves in each of the side filtering direction and the top filtering direction, the particulate 70 is collected in the particulate chamber 104 and the filtered process fluid 154 is directed through the filter screen and into the flow channels 56 of the impeller 16 that originate below the receiver 28. In certain aspects of the device, the filter cartridge 40 can also include apertures 282 that are defined within the outer wall 380 of the filter cartridge 40. In this configuration, the apertures 282 in the outer wall 380 provide for the movement of process fluid 54 through the apertures 282 of the receiver wall 284 and into the filter cartridge 40 in each of the top filter direction 354 and the side filter direction 356. The apertures 282 in the outer wall 380 can also be used as a locking recess 304 that receives a locking tab 300 of the cap 370 or the filter member 372. In this manner, the filter cartridge 40 can include a plurality of apertures 282 within the outer wall 380 that can receive locking tabs 300 in a plurality of rotational orientations. There can be more apertures 282 than locking tabs 300 so that the excess apertures 282 can operate to provide for a flow of process fluid 54 therethrough, as described herein.

According to the various aspects of the device, as exemplified in FIGS. 30-38, the removable agitator 18 can include various release mechanisms 90, as described herein. The release mechanism 90 can be installed within a handle 392 that is positioned at a top portion 390 of the removable agitator 18 or can include a release mechanism 90 that is positioned within a sidewall 92 of the removable agitator 18, as generally set forth in FIGS. 1-22. The base 160 of the removable agitator 18 engages a connecting portion 394 of the receiver 28. Through this engagement, the base 160 of the removable agitator 18 biases the filter cassette in a downward direction when the removable agitator 18 is in the installed position 214 and connected with the connecting portion 394 of the receiver 28.

Figure 4:
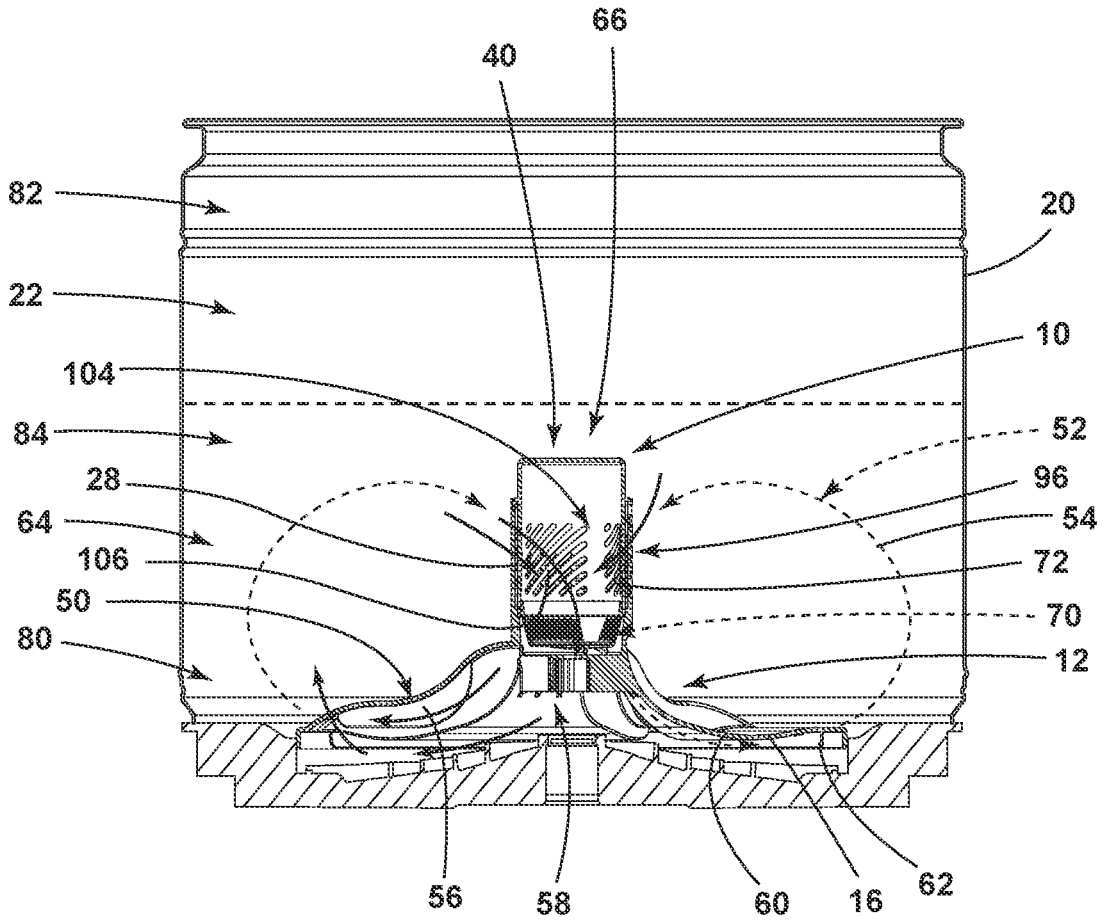
FIG. 4 is a cross-sectional view of a drum for a laundry appliance and showing an aspect of the impeller that receives the filtration structure.
Figure 5:
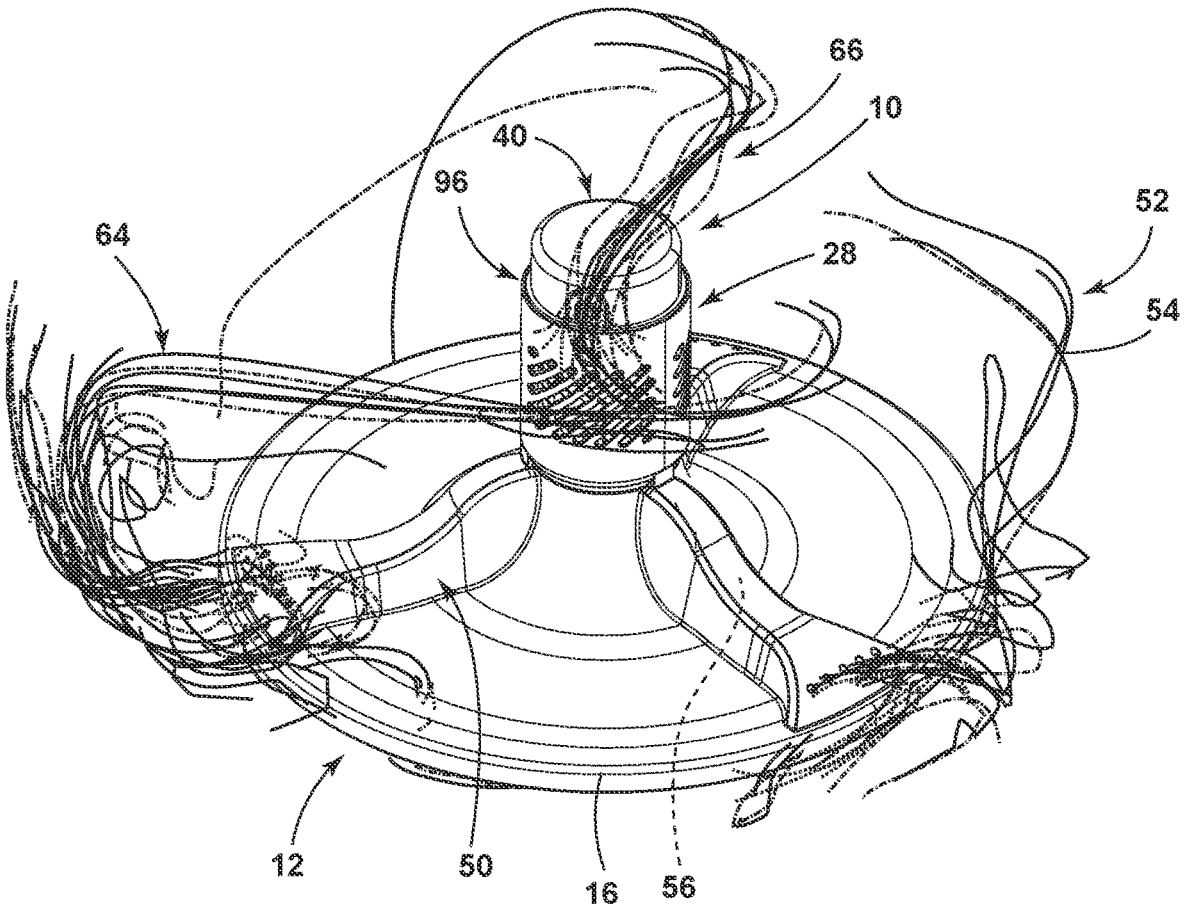
FIG. 5 is a schematic perspective view of an impeller for a laundry appliance and showing a toroidal flow of fluid generated through operation of the impeller with respect to the drum.
Figure 6:
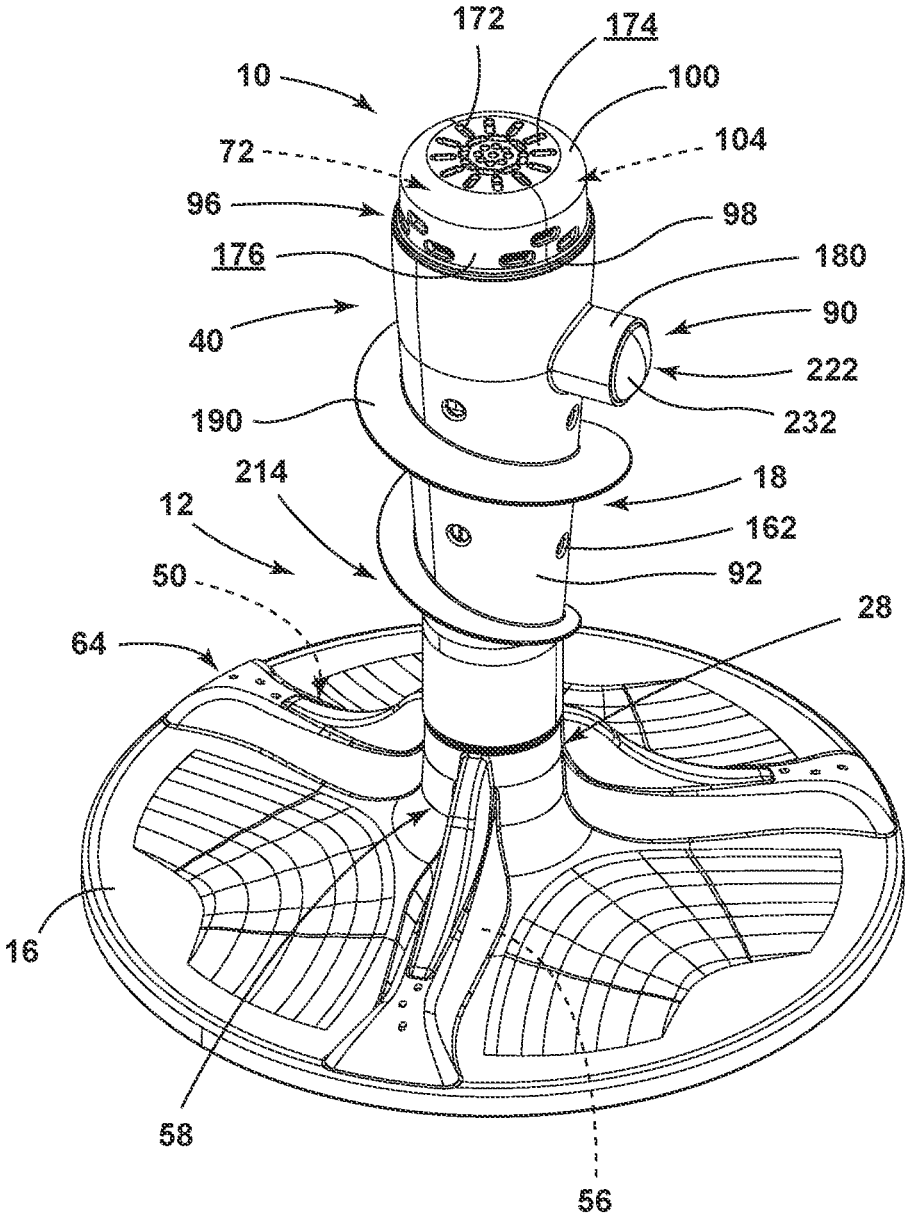
FIG. 6 is a perspective view of an aspect of the filtration structure shown in an installed position within a receiver of the impeller.
Figure 7:
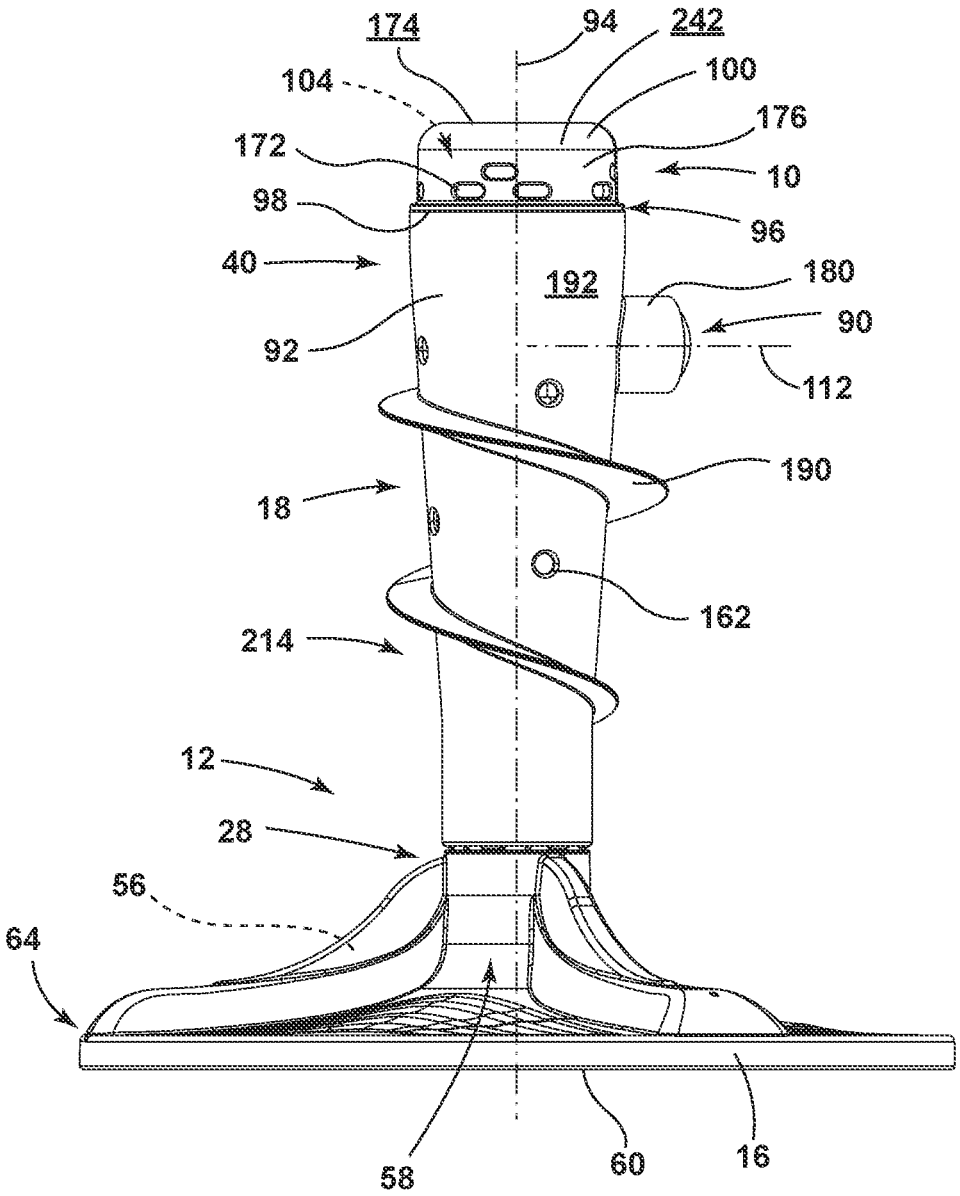
FIG. 7 is a side elevational view of the impeller and removable agitator of FIG. 6.
Figure 8:
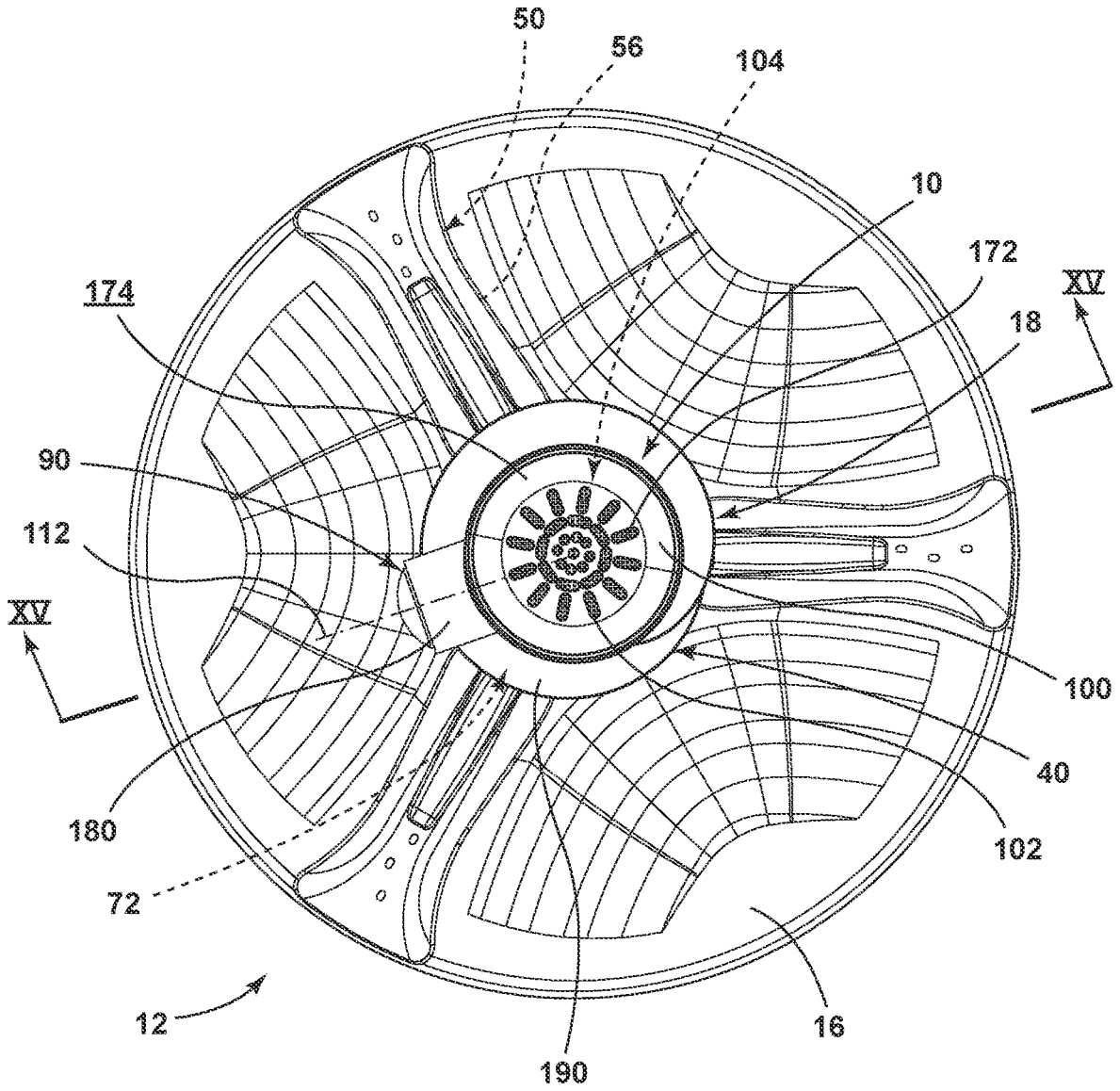
FIG. 8 is a top plan view of the impeller and removable agitator of FIG. 6.
Figure 9:
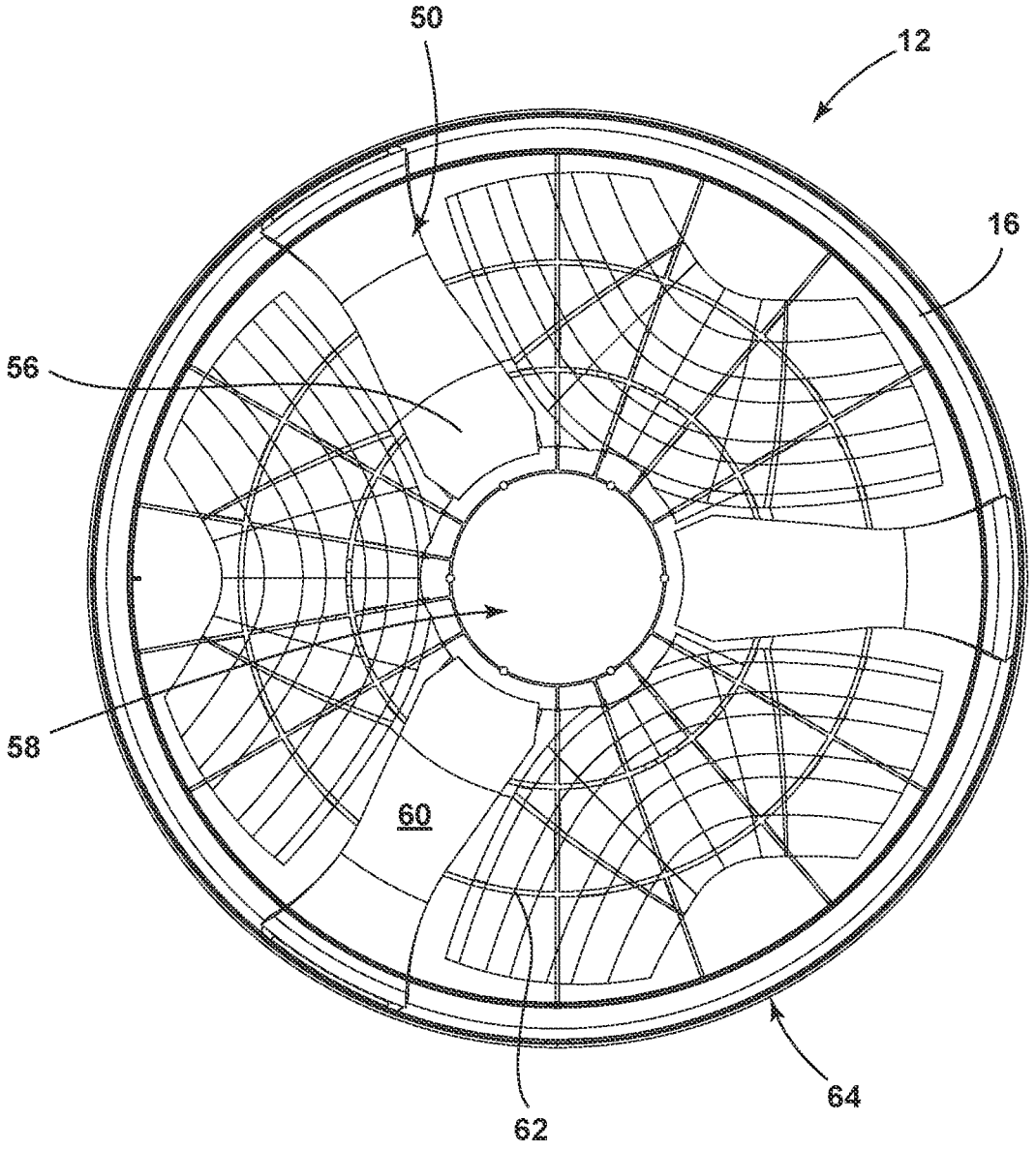
FIG. 9 is a bottom plan view of the impeller of FIG. 6.
Figure 10:
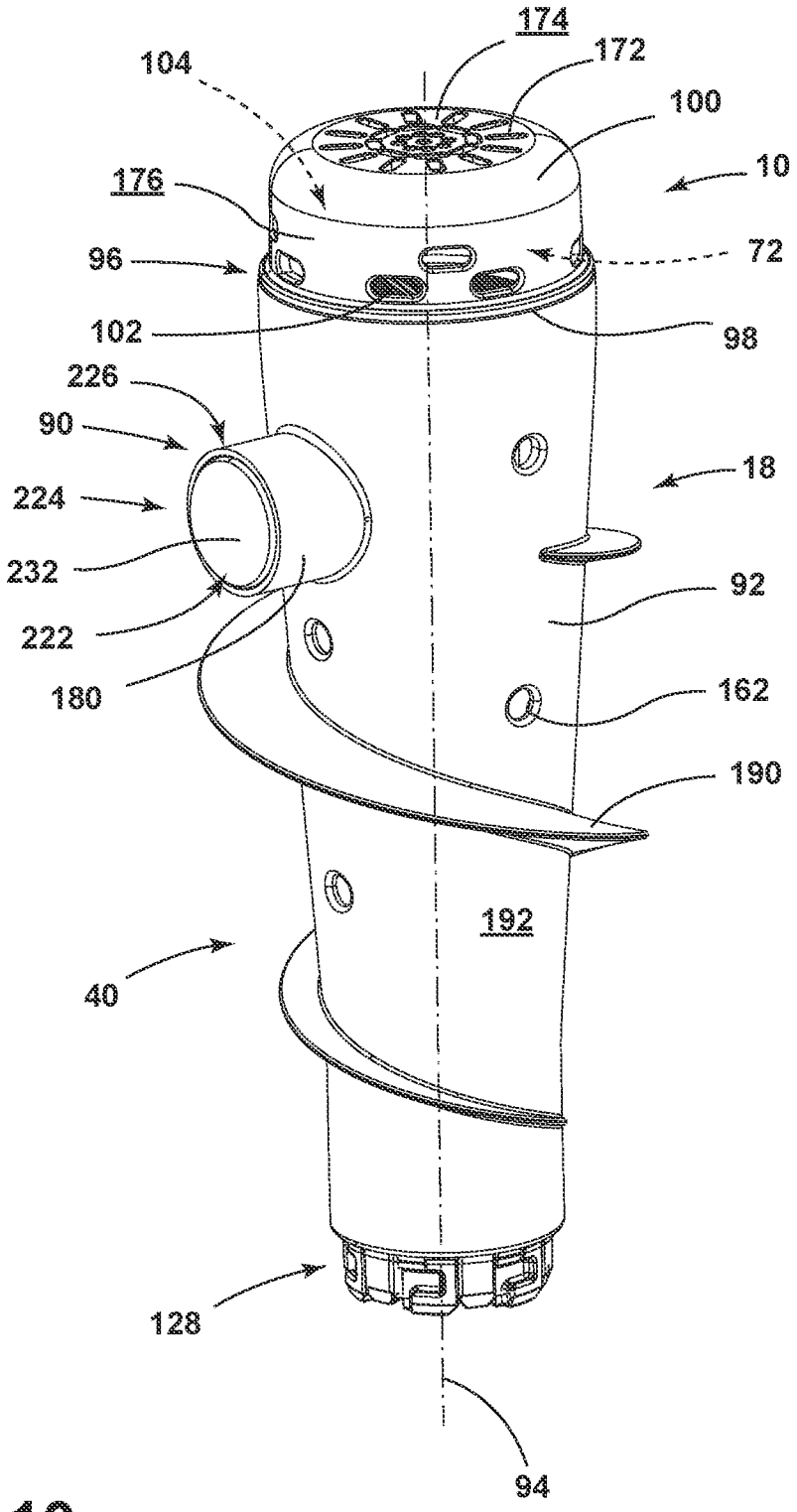
FIG. 10 is a perspective view of the removable agitator having an aspect of the filtration structure.
Figure 11:
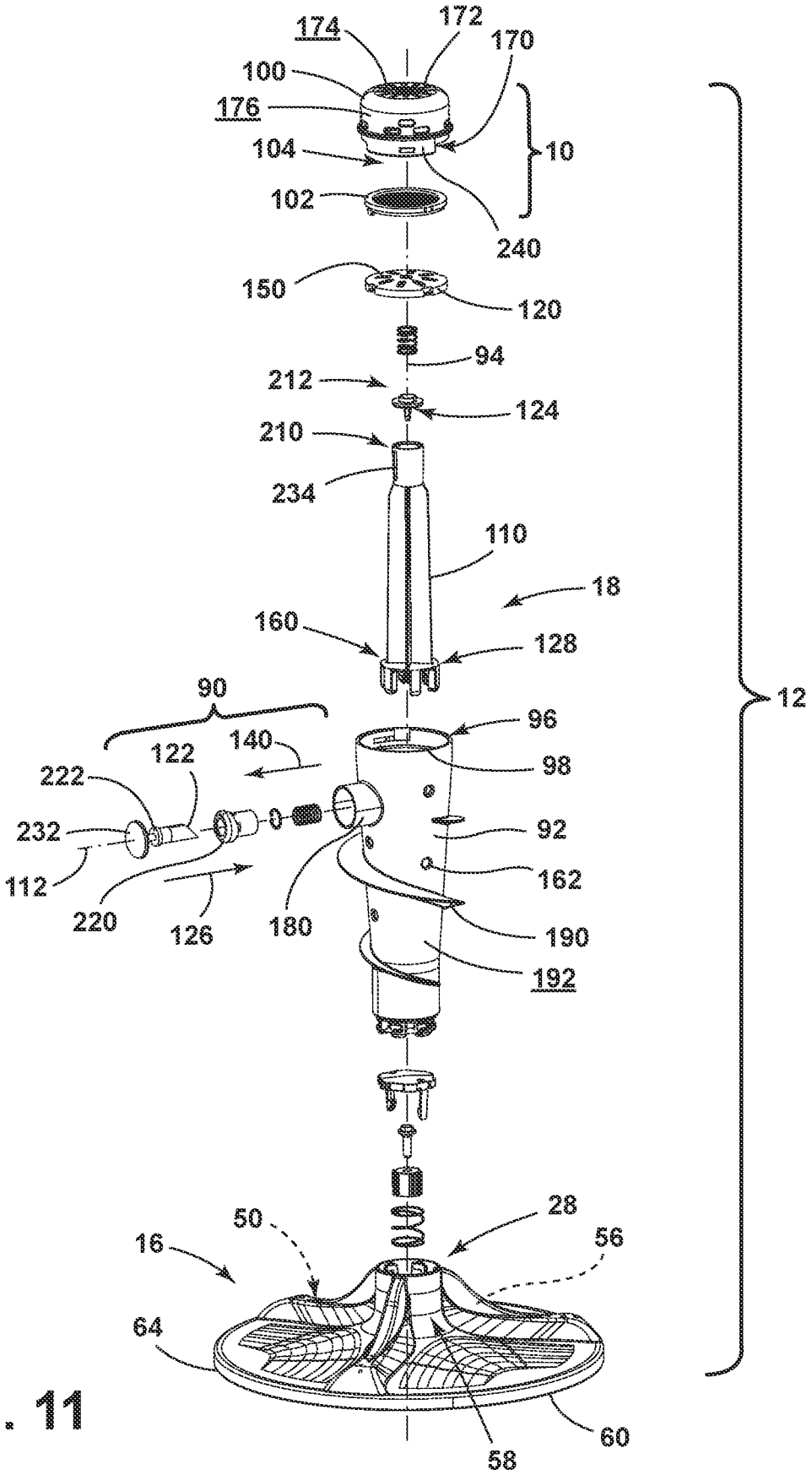
FIG. 11 is an exploded perspective view of the impeller and removable agitator of FIG. 6.
Figure 12:
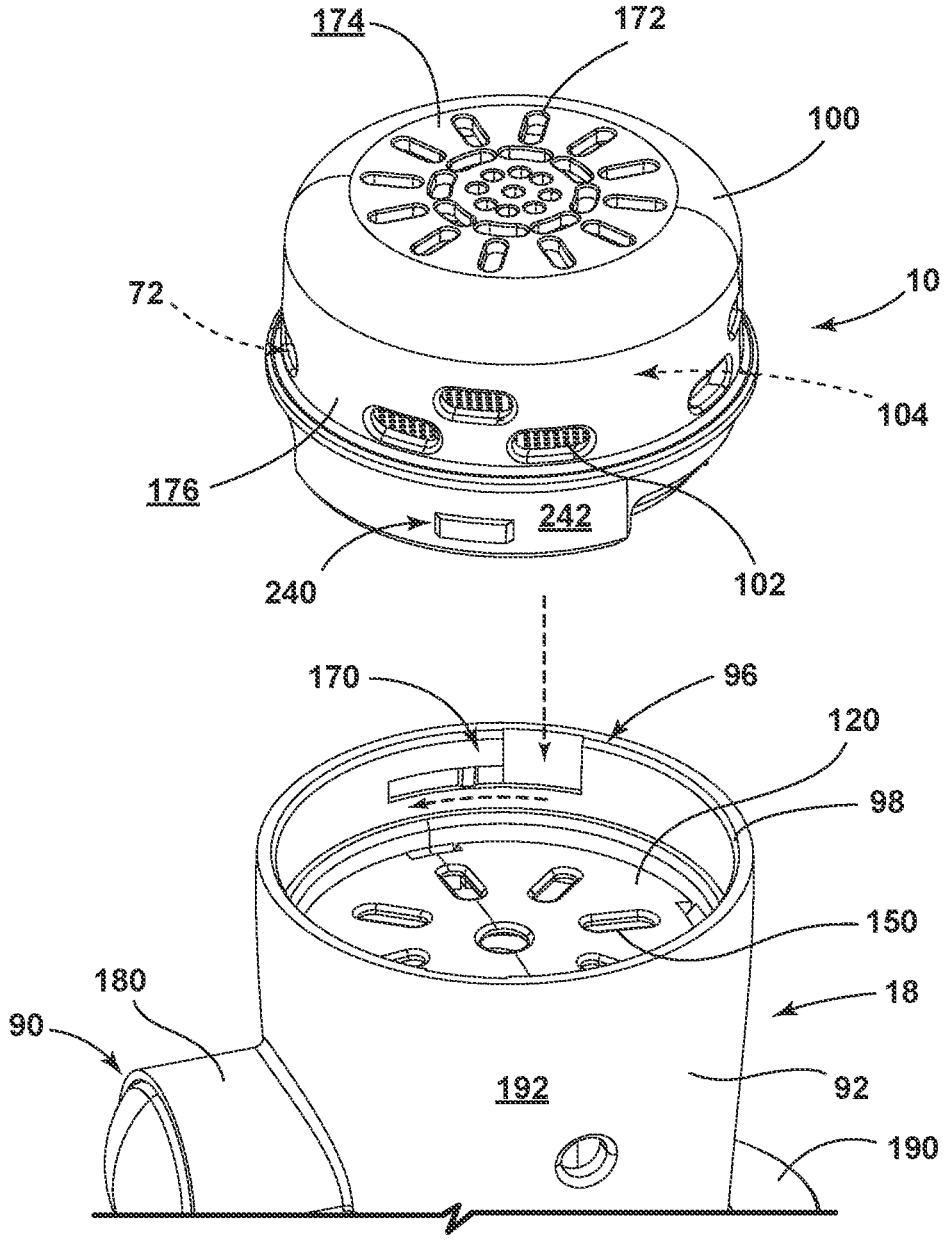
FIG. 12 is an enlarged exploded perspective view of the filtration structure removed from the removable agitator of FIG. 11.
Figure 13:
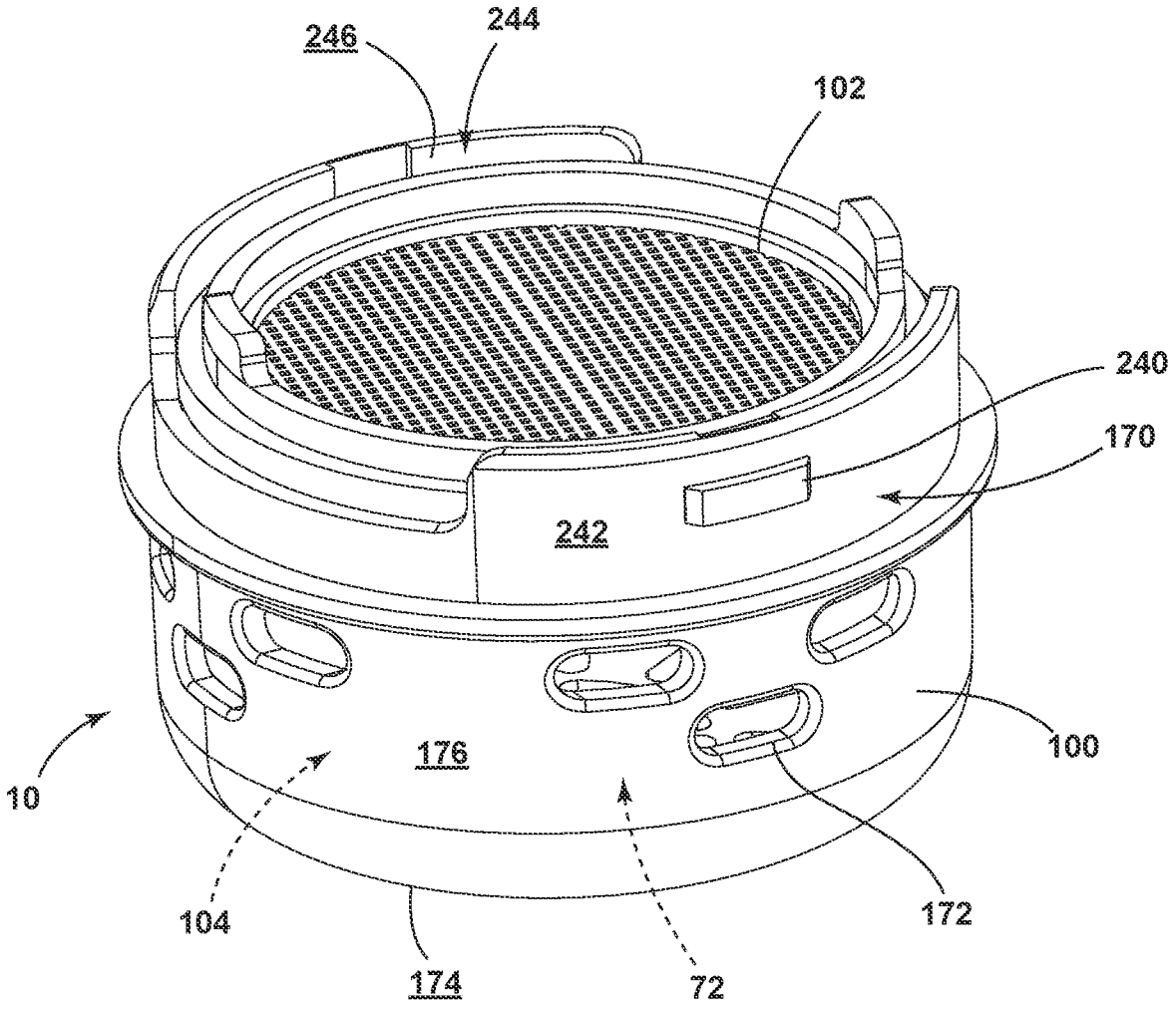
FIG. 13 is a bottom perspective view of the filtration structure of FIG. 12.
Figure 14:
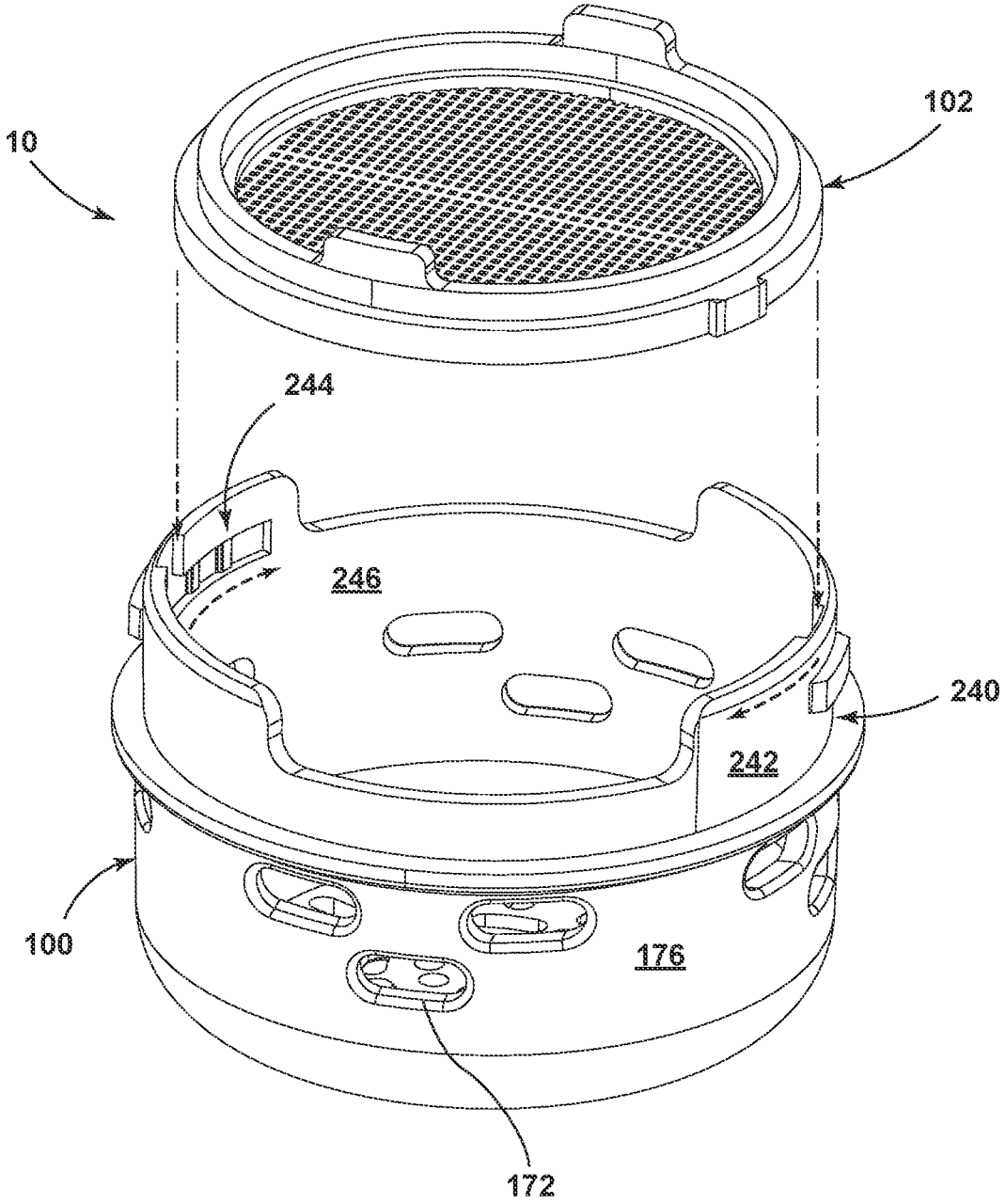
FIG. 14 is an exploded perspective view of the filtration structure of FIG. 13.
Figure 15:
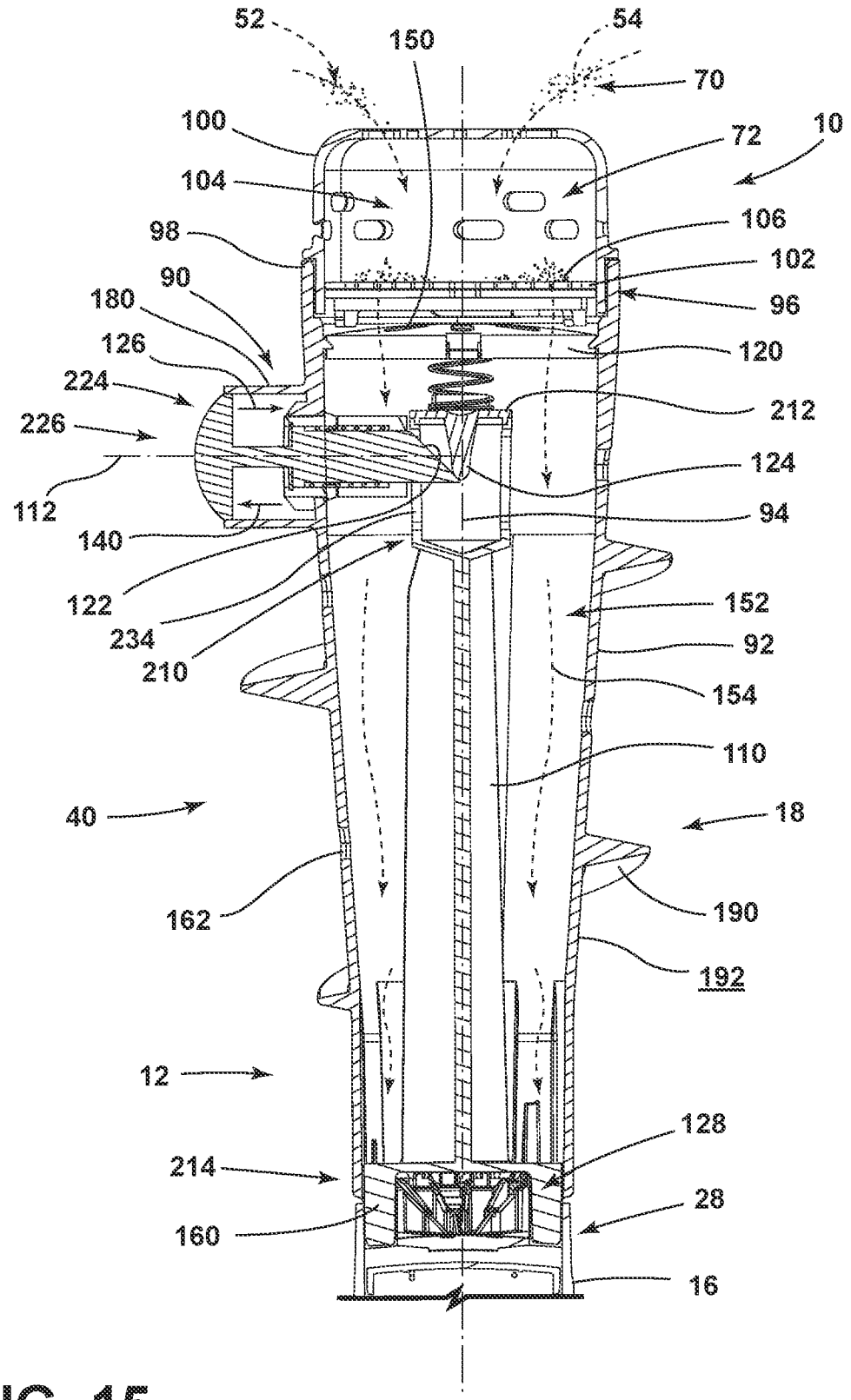
FIG. 15 is a cross-sectional view of the removable agitator of FIG. 8 taken along the line XV-XV and showing the removable agitator in the installed position.
Figure 16:
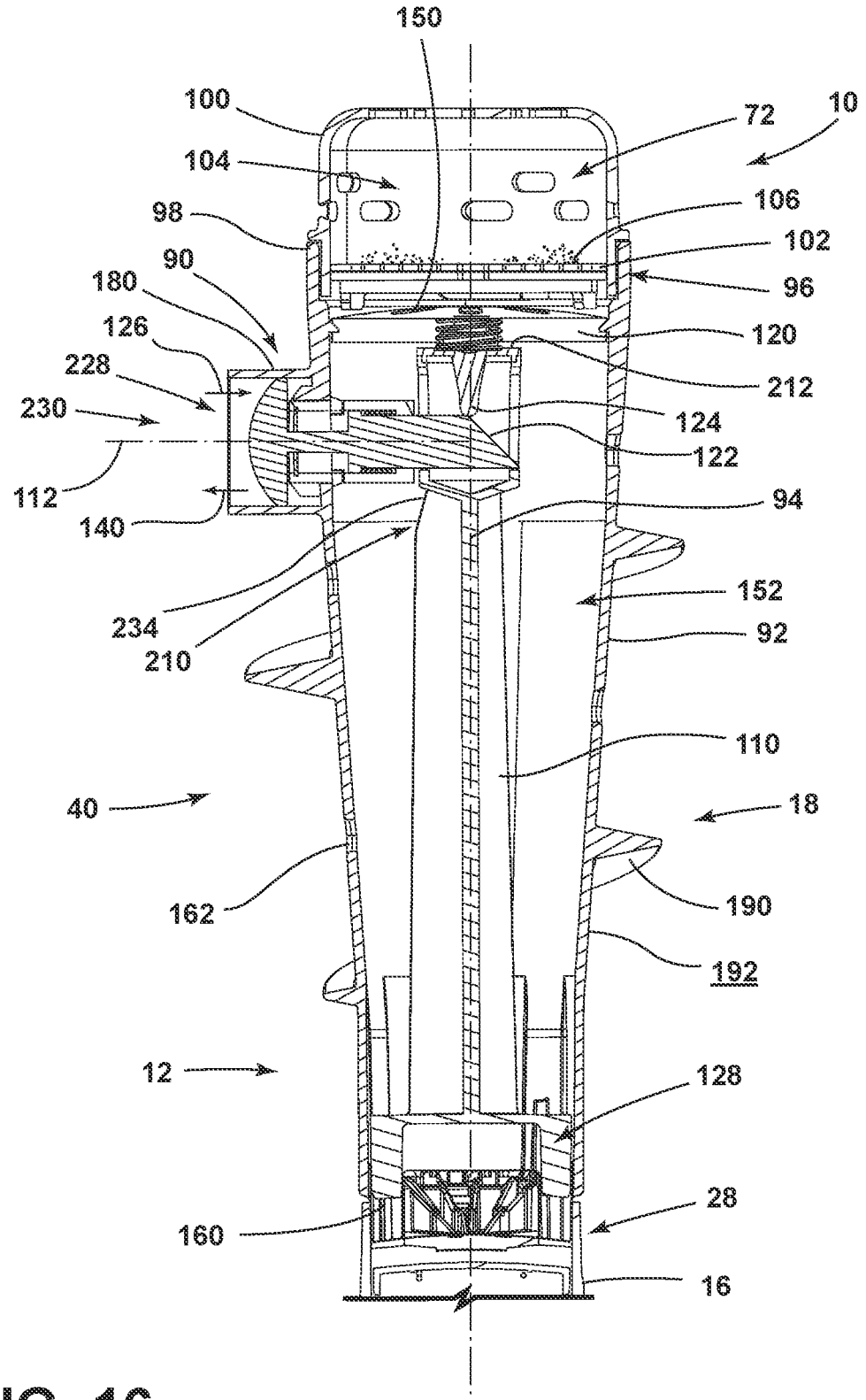
FIG. 16 is cross-sectional view of the removable agitator of FIG. 15 and showing operation of a release mechanism to a release position that disengages the removable agitator from the receiver of the impeller.
Figure 17:
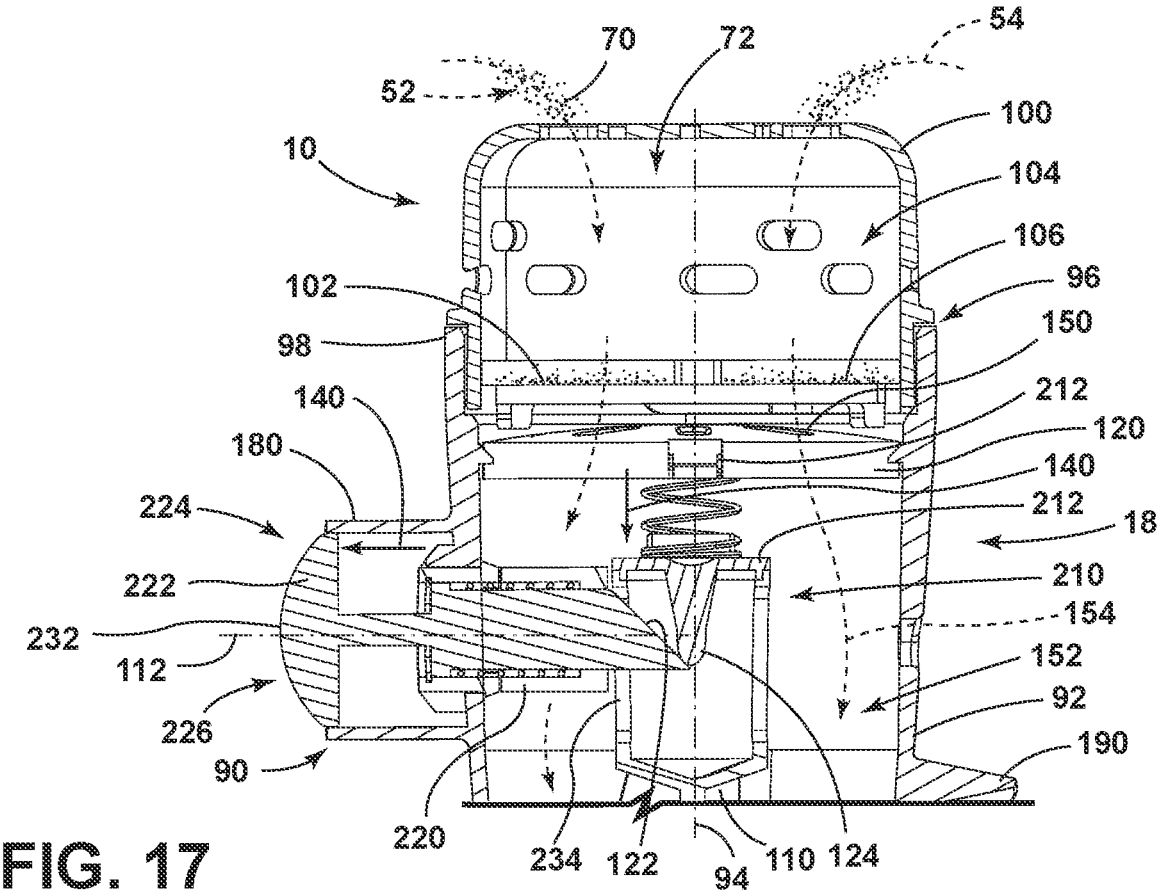
FIG. 17 is an enlarged cross-sectional view of the release mechanism of the removable agitator in an idle state.
Figure 18:
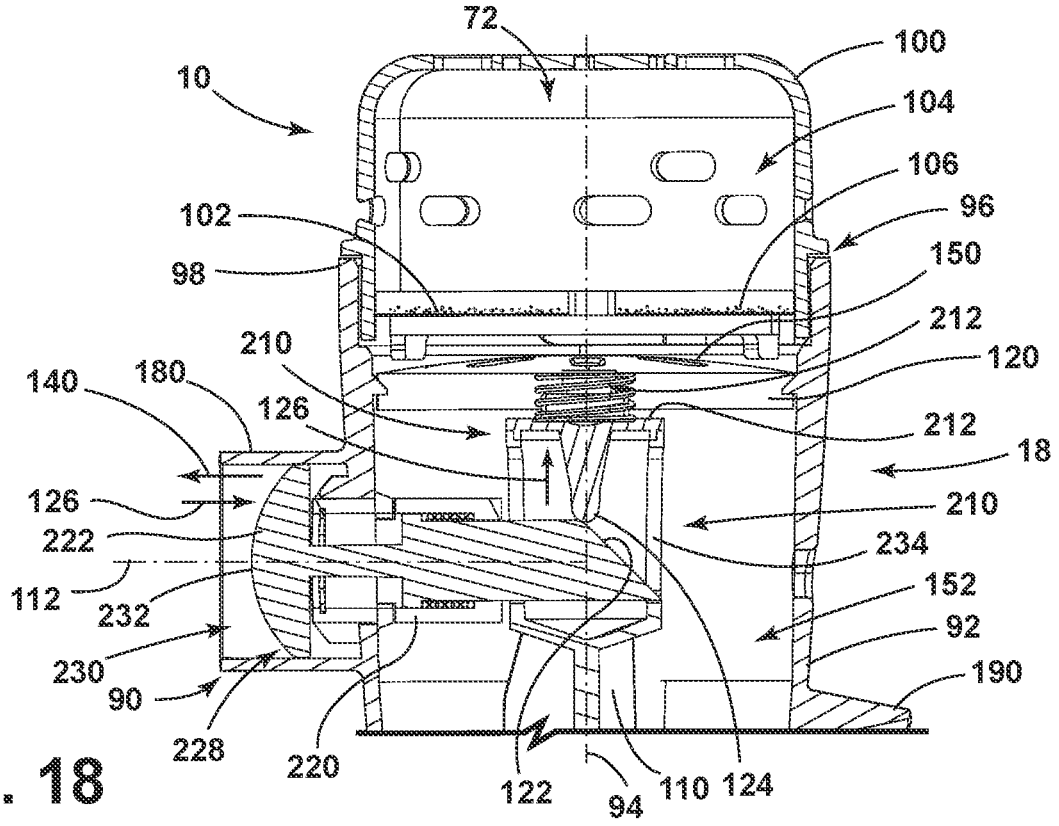
FIG. 18 is an enlarged cross-sectional view of the release mechanism of FIG. 17 and showing the release mechanism in the release position.
Figure 19:
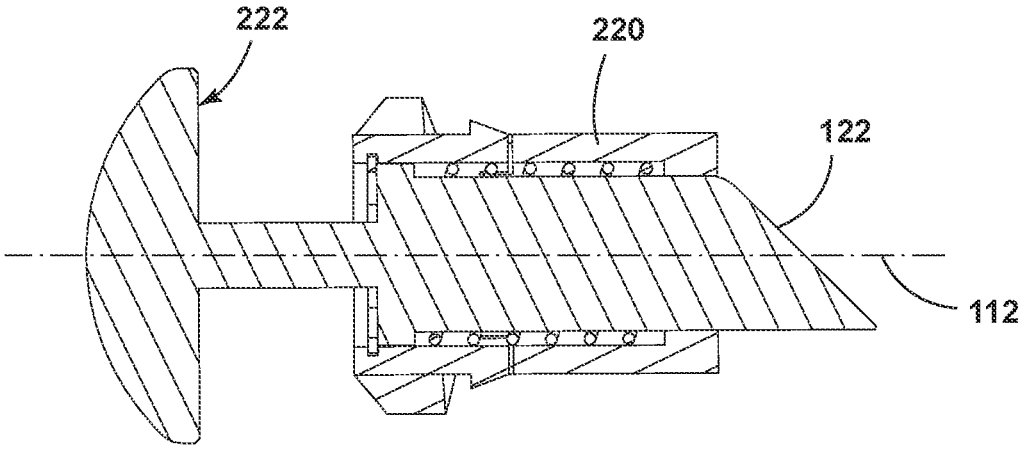
FIG. 19 is an enlarged cross-sectional perspective view of an aspect of the release mechanism.
Figure 20:
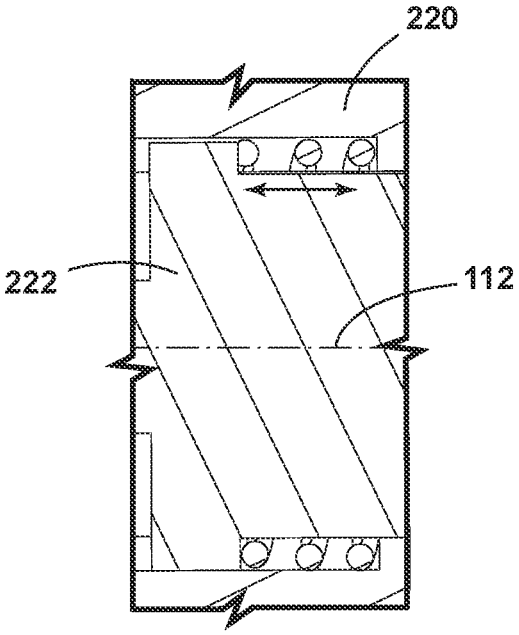
FIG. 20 is a schematic cross-sectional view of the release mechanism of FIG. 19 and showing an enlarged view of the biasing mechanism.
Figure 21:
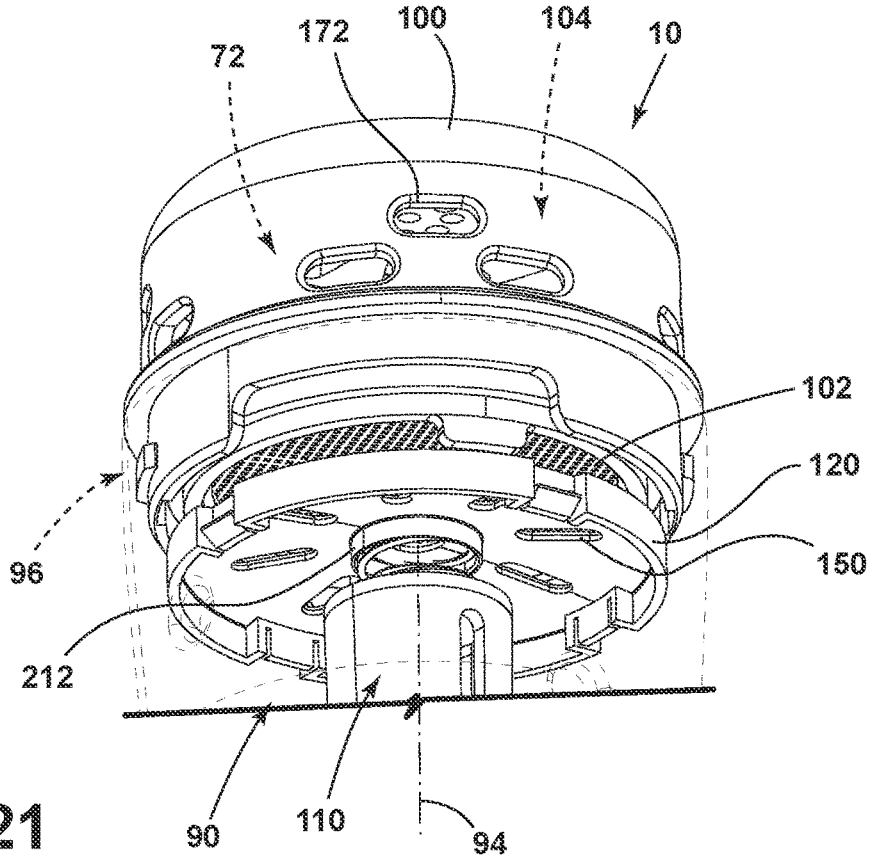
FIG. 21 is an enlarged perspective view of the removable agitator with the sidewall removed and showing interaction of the release mechanism with a structural plate beneath the filtration structure.
Figure 22:
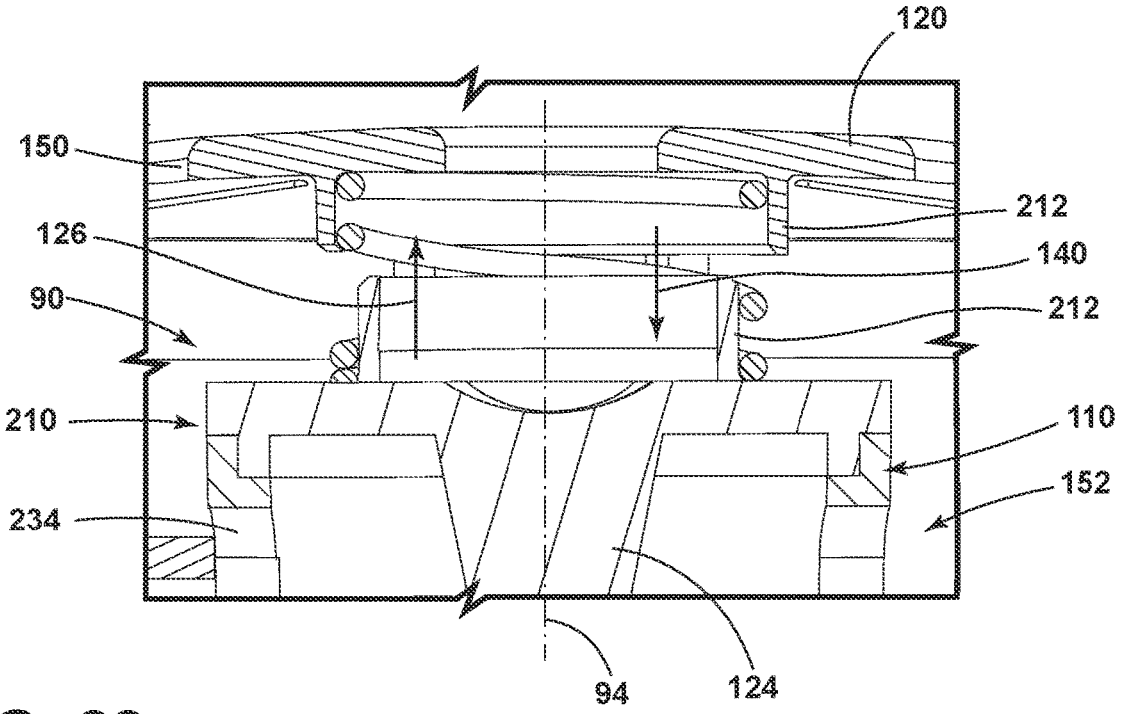
FIG. 22 is a cross-sectional view of the structural plate and biasing mechanism for the removable agitator.
Figure 23:
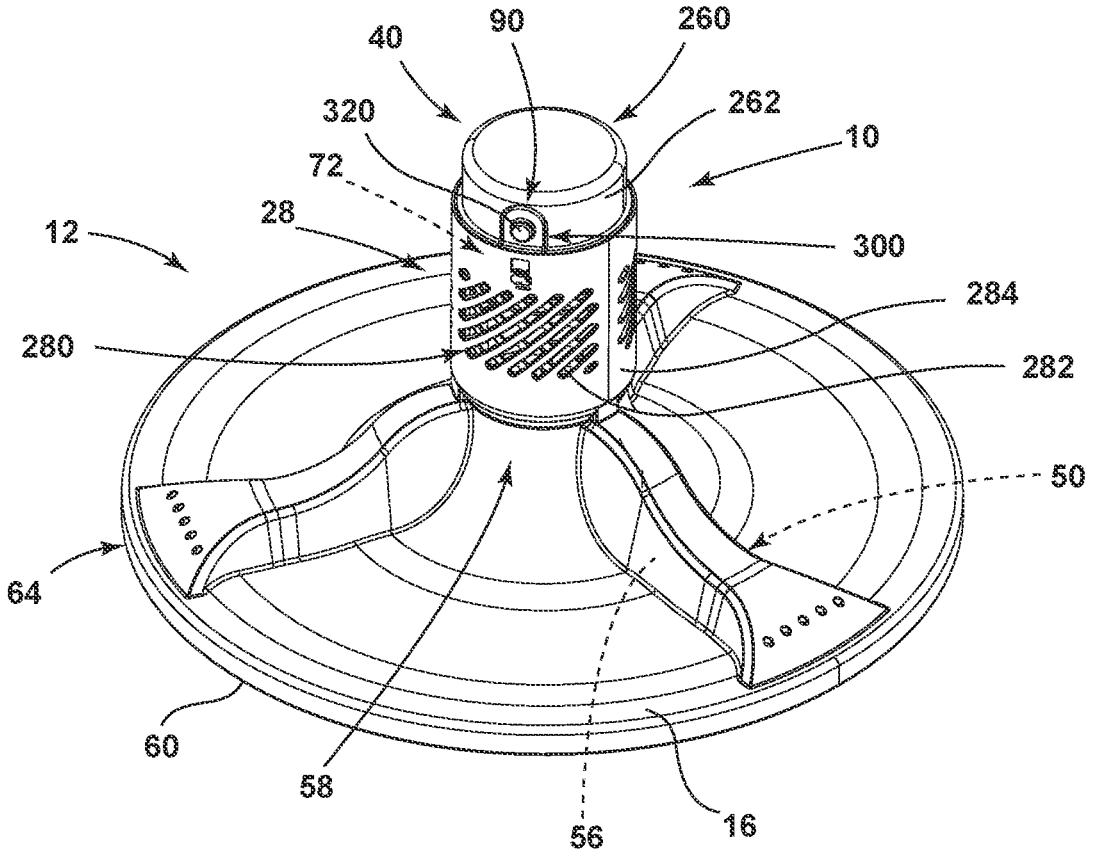
FIG. 23 is a perspective view of an aspect of the filtration structure installed within a receiver of the impeller.
Figure 24:
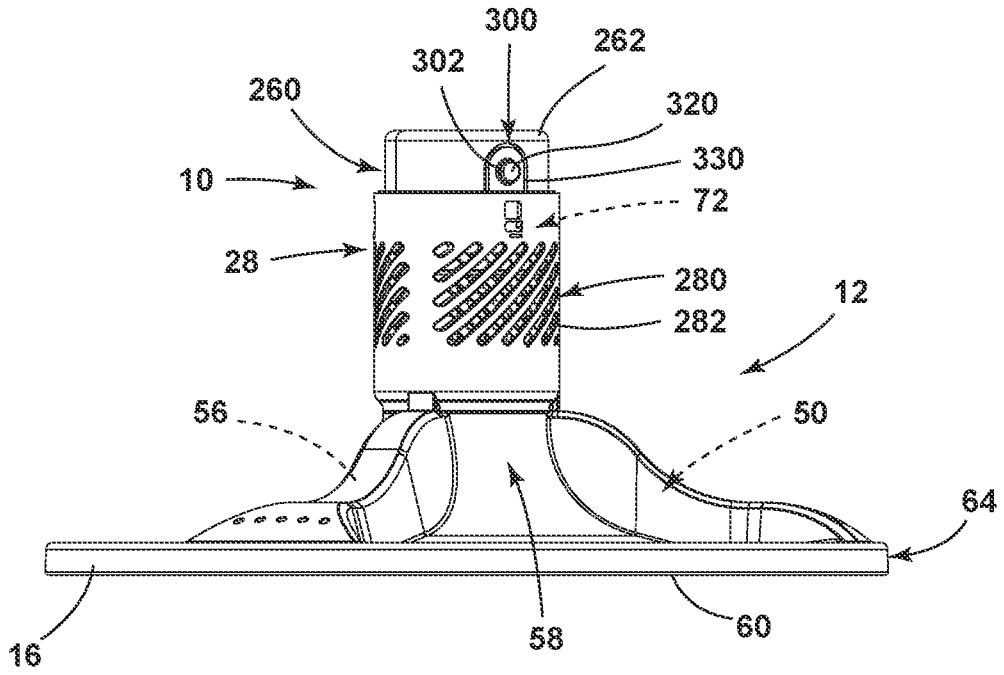
FIG. 24 is a side elevational view of the impeller of FIG. 23.
Figure 25:
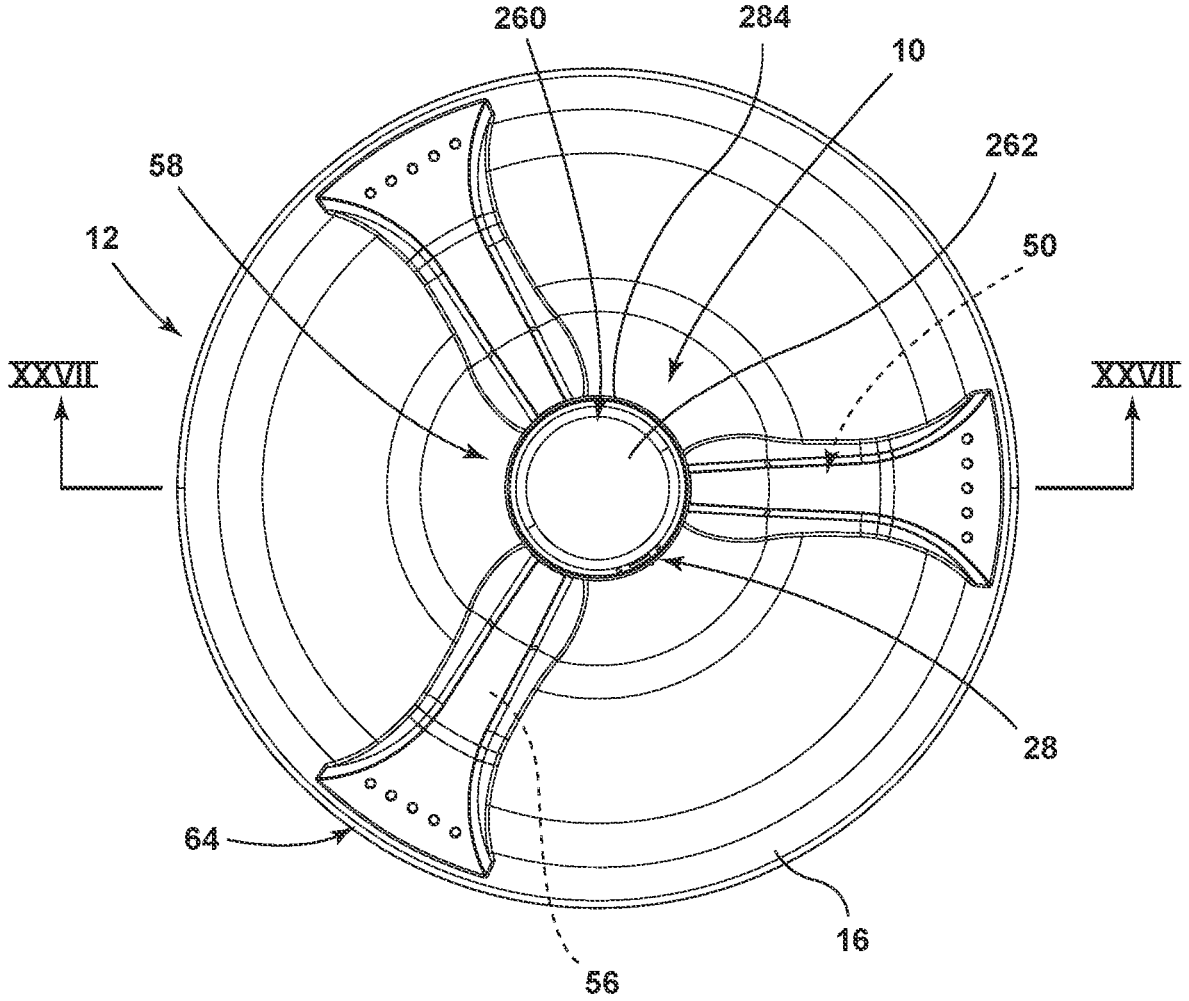
FIG. 25 is a top plan view of the impeller of FIG. 23.
Figure 26:
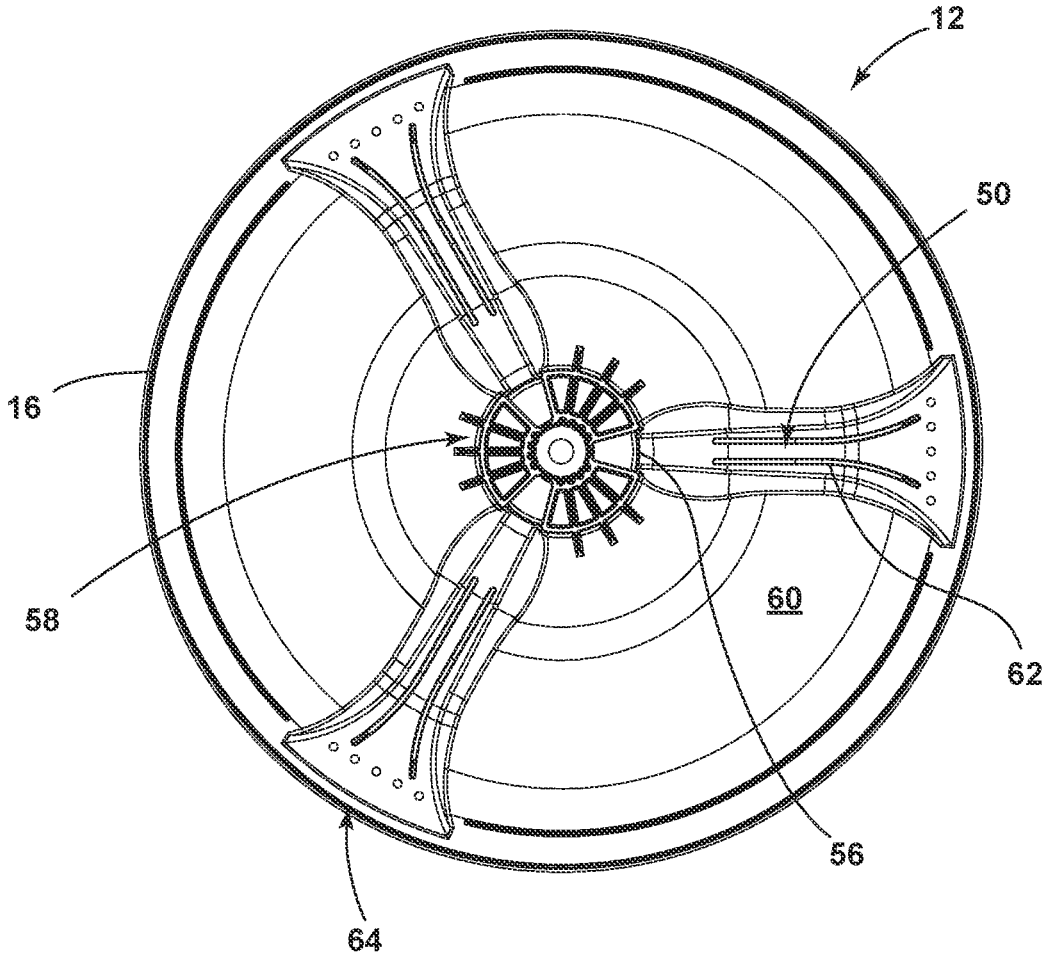
FIG. 26 is a bottom plan view of the impeller of FIG. 23.

According to the various aspects of the device, as exemplified in FIGS. 4 and 5, the impeller 16 that is incorporated within the rotator 12 can also include a receiver cap 400 that fits over the receiver 28. This receiver cap 400 can be utilized where neither the removable filter 262 nor the removable agitator 18 are installed within the receiver 28. In these situations, the receiver cap 400 can provide a low-profile filtration structure 10 that can be utilized with small loads of laundry. It is contemplated that the receiver cap 400 can include a filter screen that separates the particulate 70 from the process fluid 54 so that filtered process fluid 154 can be directed into the flow channels 56 of the impeller 16.

According to the various aspects of the device, the aspects of the filtration structure 10 are utilized for capturing particulate 70 from process fluid 54 that moves in a toroidal flow 52 through a processing space 22 of the drum 20. Additionally, the various filtration structures 10 can be utilized in an interchangeable configuration with a particular receiver 28. Accordingly, a receiver 28 of an impeller 16 can be configured to receive, alternatively, a removable filter 262 and a removable agitator 18 depending upon the type of cycle being performed in the appliance 14. Additionally, the receiver 28 can be used in connection with removable filters 262 of varying sizes that can be utilized depending upon the fluid level of the process fluid 54 within a particular laundry cycle. Accordingly, an appliance 14 can be fitted with a series of removable filters 262 that can be used in conjunction with a small load of laundry, a medium load of laundry, or large loads of laundry. Typically, where a large load of laundry is utilized, an agitator 18 will be utilized that includes an internal filtration structure 10. Where smaller loads of laundry are utilized, the agitator 18 may not be needed such that a removable filter 262 can be utilized instead of the removable agitator 18. In this configuration, the user can install a particular removable cassette 260 that can take the form of a removable filter 262 or the removable agitator 18 depending upon the needs of the user.

The invention disclosed herein is further summarized in the following paragraphs and is further characterized by combinations of any and all of the various aspects described therein.

According to one aspect of the present disclosure, a laundry appliance includes a drum that is rotationally operable within a tub and a rotator that is rotationally operable relative to the drum. The rotator includes an impeller that is axially fixed with respect to the drum and includes a receiver, a removable agitator that is selectively coupled with the receiver, and a filtration structure that is disposed at least within the removable agitator.

According to another aspect, the removable agitator includes a release mechanism that is disposed within a sidewall of the removable agitator. The release mechanism operates in a direction that is perpendicular to a longitudinal axis of the removable agitator.

According to another aspect, the removable agitator includes a filtration receptacle that is positioned at an end of the sidewall adjacent to the release mechanism.

According to another aspect, the filtration receptacle receives the filtration structure that includes a cap member having a filtration screen coupled with the cap member. The cap member is selectively removable from the filtration receptacle.

According to another aspect, the filtration screen and the cap member define a particulate chamber that holds captured particulate therein. The filtration screen is selectively separable from the cap member to provide access to the particulate chamber.

According to another aspect, the release mechanism of the removable agitator includes an internal shaft that is axially operated along the longitudinal axis via operation of the release mechanism. The release mechanism is positioned between the internal shaft and the filtration structure.

According to another aspect, the filtration receptacle includes a structural plate and a biasing mechanism that is coupled to the structural plate and the internal shaft. The biasing mechanism biases the internal shaft away from the structural plate and toward a base of the removable agitator that selectively engages the receiver.

According to another aspect, the structural plate includes a plurality of plate openings that define an internal flow space within the sidewall that permits passage of filtered fluid from the filtration structure and through flow channels defined within the impeller.

According to another aspect, the release mechanism is positioned within a grasping structure of the removable agitator.

According to another aspect of the present disclosure, a laundry appliance includes a drum that is rotationally operable within a tub and a rotator that is rotationally operable relative to the drum. The rotator includes an impeller that is axially fixed with respect to the drum and includes a receiver, a removable cassette that is selectively coupled with the receiver, and a filtration structure that is disposed at least within the receiver of the impeller.

According to another aspect, the removable cassette is one of a removable agitator and a removable filter.

According to another aspect, when the removable cassette is the removable agitator, the filtration structure is fully defined within the impeller and includes a filter cartridge that moves between a first filtering position and a second filtering position. The first filtering position is defined when the removable agitator is coupled with the receiver, and the second filtering position is defined when the removable agitator is detached from the receiver.

According to another aspect, the filter cartridge is biased toward the second filtering position.

According to another aspect, the receiver includes a plurality of apertures within an outer wall of the receiver. The filter cartridge in the second filtering position at least partially obstructs the plurality of apertures.

According to another aspect, when the removable cassette is the removable filter, the removable filter includes a filter wall and a filter cup that defines a portion of the filtration structure. The filter wall is selectively attached to the receiver to define an installed position of the removable filter.

According to another aspect, the filtration structure includes a first set of apertures that are defined within the receiver and a second set of apertures that are defined within the filter wall. The first set of apertures align with the second set of apertures.

According to another aspect, the removable cassette includes a locking tab that is positioned within a deflecting portion of the filter wall. The locking tab selectively engages a locking recess of the receiver.

According to another aspect, the filter wall includes a grasping feature that is included within the deflecting portion of the filter wall. Engagement of the grasping feature operates inwardly to deflect the locking tab to selectively disengage the locking tab from the locking recess.

According to yet another aspect of the present disclosure, a laundry appliance includes a drum that is rotationally operable within a tub and a rotator that is rotationally operable relative to the drum. The rotator includes an impeller that is axially fixed with respect to the drum and includes a receiver, a removable agitator that is selectively coupled with the receiver, and a filtration structure that is defined by the receiver and operable between a first filtering position characterized by the removable agitator being in an installed position and a second filtering position characterized by the removable agitator separated from the receiver.

According to another aspect, the filtration structure includes a filter cartridge that is disposed within the receiver having a plurality of flow apertures. Attachment of the removable agitator moves the filter cartridge to the first filtering position that is defined by a movement of process fluid through the plurality of flow apertures. Separation of the removable agitator from the receiver moves the filter cartridge to the second filtering position that is defined by a removable cassette interfering the plurality of flow apertures and the movement of the process fluid through a top set of filtering apertures of the filter cartridge.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a drum that is rotationally operable within a tub; and a rotator that is rotationally operable relative to the drum, the rotator comprising:

an impeller that is axially fixed with respect to the drum and including a receiver;

a removable agitator that is selectively coupled with the receiver; and a filtration structure that is disposed at least within the receiver of the impeller, wherein the filtration structure is fully defined within the receiver of the impeller and includes a filter cartridge that moves vertically between a first filtering position and a second filtering position, the first filtering position defined when the removable agitator is coupled with the receiver and the second filtering position defined when the removable agitator is detached from the receiver.

2. The laundry appliance of claim 1, wherein the filter cartridge is biased toward the second filtering position.

3. The laundry appliance of claim 2, wherein the impeller includes a spring that is disposed within the receiver for biasing the filter cartridge toward the second filtering position.

4. The laundry appliance of claim 3, wherein the spring is attached to a structural plate that engages a bottom surface of the filter cartridge.

5. The laundry appliance of claim 4, wherein the structural plate includes a plurality of plate openings that allow process fluid to pass therethrough.

6. The laundry appliance of claim 2, wherein the filter cartridge includes a filter member that is attached to a cap.

7. The laundry appliance of claim 6, wherein the filter member and the cap are selectively secured together to define a filtration chamber therein.

8. The laundry appliance of claim 7, wherein the cap includes a top set of apertures that allow process fluid to enter into the filtration chamber, and wherein the filter member includes a filter screen that separates particulate from the process fluid to define filtered process fluid that is directed through plate apertures of a structural plate of the receiver.

9. The laundry appliance of claim 1, wherein the receiver includes a plurality of apertures within an outer wall of the receiver, and wherein the filter cartridge in the second filtering position at least partially obstructs the plurality of apertures.

10. The laundry appliance of claim 1, wherein the filter cartridge includes a solid outer wall and a top set of filtering apertures, wherein the first filtering position is characterized by the top set of filtering apertures being in communication with side apertures of the receiver.

11. The laundry appliance of claim 10, wherein the second filtering position is characterized by the solid outer wall blocking the side apertures of the receiver and the top set of filtering apertures positioned proximate a top of the receiver.

12. A laundry appliance comprising:

a drum that is rotationally operable within a tub; and a rotator that is rotationally operable relative to the drum, the rotator comprising:

an impeller that is axially fixed with respect to the drum and including a receiver;

a removable agitator that is selectively coupled with the receiver; and a filtration structure that is defined by the receiver and operable between a first filtering position characterized by the removable agitator being in an installed position, and a second filtering position characterized by the removable agitator separated from the receiver, wherein the filtration structure includes a filter cartridge that is disposed within the receiver having a plurality of flow apertures, wherein attachment of the removable agitator moves the filter cartridge to the first filtering position defined by a movement of process fluid through the plurality of flow apertures, and wherein separation of the removable agitator from the receiver moves the filter cartridge to the second filtering position defined by a removable cassette interfering with the plurality of flow apertures and the movement of the process fluid through a top set of filtering apertures of the filter cartridge.

13. The laundry appliance of claim 12, wherein the filter cartridge is selectively removable from the receiver from the second filtering position.

14. The laundry appliance of claim 12, wherein each of the removable agitator and the filter cartridge are selectively removable from the receiver.

15. The laundry appliance of claim 12, wherein the impeller includes a spring that is disposed within the receiver for biasing the filter cartridge toward the second filtering position.

16. The laundry appliance of claim 15, wherein the spring is attached to a structural plate that engages a bottom surface of the filter cartridge.

17. The laundry appliance of claim 16, wherein the structural plate includes a plurality of plate openings that allow the process fluid to pass therethrough.

18. The laundry appliance of claim 12, wherein the filter cartridge includes a filter member that is attached to a cap.

19. The laundry appliance of claim 18, wherein the filter member and the cap are selectively secured together to define a filtration chamber therein.

20. The laundry appliance of claim 19, wherein the cap includes a top set of apertures that allow the process fluid to enter into the filtration chamber, and wherein the filtration member includes a filter screen that separates particulate from the process fluid to define filtered process fluid that is directed through a structural plate of the receiver.

* * * * *